US011633774B2

(12) United States Patent
Murata

(10) Patent No.: US 11,633,774 B2
(45) Date of Patent: Apr. 25, 2023

(54) MACHINED ARTICLE AND PRESSING METHOD

(71) Applicant: HODEN SEIMITSU KAKO KENKYUSHO CO., LTD., Atsugi (JP)

(72) Inventor: Chikara Murata, Zama (JP)

(73) Assignee: HODEN SEIMITSI KAKO KENKYUSHO CO., LTD., Atsugi (JP)

( * ) Notice: Subject to any disclaimer, the term of this patent is extended or adjusted under 35 U.S.C. 154(b) by 135 days.

(21) Appl. No.: 16/014,229

(22) Filed: Jun. 21, 2018

(65) Prior Publication Data

US 2018/0297100 A1 Oct. 18, 2018

Related U.S. Application Data

(63) Continuation of application No. PCT/JP2016/088672, filed on Dec. 26, 2016.

(30) Foreign Application Priority Data

Dec. 24, 2015 (JP) ..... JP2015-251427

(51) Int. Cl.
*B21D 39/00* (2006.01)
*B21D 28/26* (2006.01)
(Continued)

(52) U.S. Cl.
CPC ..... *B21D 28/26* (2013.01); *B21D 28/24* (2013.01); *B21D 37/08* (2013.01); *B21D 39/00* (2013.01); *B21D 39/03* (2013.01)

(58) Field of Classification Search
CPC ..... B21D 28/26; B21D 28/24; B21D 37/08; B21D 39/00; B21D 39/03
See application file for complete search history.

(56) References Cited

U.S. PATENT DOCUMENTS 3,074,299 A * 1/1963 Schefer ..... G21C 3/36 72/113
3,093,887 A * 6/1963 Prestige ..... H05K 13/0465 29/845
(Continued)

FOREIGN PATENT DOCUMENTS

DE 16 04 941 B1 5/1970
DE 100 35 716 A1 3/2001
(Continued)

OTHER PUBLICATIONS

Extended European Search Report dated Jul. 12, 2019, issued by the European Patent Office in application No. 16879041.8.
(Continued)

*Primary Examiner* — Nirvana Deonauth
(74) *Attorney, Agent, or Firm* — Sughrue Mion, PLLC

(57) ABSTRACT

A machined article 100 includes a first member 101 including an inner peripheral portion 101*a* formed by a hole, and a second member including an outer peripheral portion 102*a* fitted into the inner peripheral portion 101*a* of the first member 101. At least either an inner peripheral recess 101*b* to be formed in part of the inner peripheral portion 101*a* of the first member 101 or an outer peripheral recess 102*b* to be formed in part of the outer peripheral portion 102*a* of the second member 102 is formed. A slit 103 penetrating from a front to a back is formed at a position to which the inner peripheral recess 101*b* or the outer peripheral recess 102*b* corresponds, between the first member 101 and the second member 102.

13 Claims, 38 Drawing Sheets

(51) Int. Cl.

| | |
|---|---|
| ***B21D 28/24*** | (2006.01) |
| ***B21D 37/08*** | (2006.01) |
| ***B21D 39/03*** | (2006.01) |

(56) References Cited

U.S. PATENT DOCUMENTS

| | | | | | |
|---|---|---|---|---|---|
| 3,534,466 | A * | 10/1970 | Ardolino | B21D 39/03 | 29/509 |
| 4,728,842 | A * | 3/1988 | Martin | B21D 39/032 | 29/564.2 |
| 7,235,910 | B2 * | 6/2007 | Decristofaro | H01F 1/15333 | 310/216.065 |
| 8,159,094 | B2 * | 4/2012 | Ruffing | H02K 1/32 | 310/61 |

FOREIGN PATENT DOCUMENTS

| | | | |
|---|---|---|---|
| DE | 101 31 474 | A1 | 5/2003 |
| JP | 4220590 | B2 | 2/2009 |
| JP | 2014-054674 | A | 3/2014 |
| JP | 2014-073046 | A | 4/2014 |

OTHER PUBLICATIONS

International Search Report of PCT/JP2016/088672 dated Mar. 21, 2017.

* cited by examiner

MACHINED ARTICLE AND PRESSING METHOD

CROSS-REFERENCE TO RELATED APPLICATIONS

This application is a continuation claiming priority on the basis of Japan Patent Application No. 2015-251427 applied in Japan on Dec. 24, 2015 and based on PCT/JP2016/088672 filed on Dec. 26, 2016. The contents of both the PCT application and the Japan Application are incorporated herein by reference.

BACKGROUND OF THE INVENTION AND RELATED ART STATEMENT

The present invention relates to a machined article for jetting fluid or powder from small holes, and a pressing method for machining the machined article.

To form holes or slits in a machined article, machining such as drilling has been commonly used heretofore. However, in the case of forming holes of minute dimensions, machining is difficult. There has thus been disclosed a technique for forming holes of minute dimensions by engaging and integrating a plurality of plate-like members shaped by punching (Japanese Patent No. 4,220,590).

SUMMARY OF THE INVENTION

A machined article according to the present invention includes:

a first member including an inner peripheral portion formed by a hole; and a second member including an outer peripheral portion fitted into the inner peripheral portion of the first member, wherein at least either an inner peripheral recess to be formed in part of the inner peripheral portion of the first member or an outer peripheral recess to be formed in part of the outer peripheral portion of the second member is formed, and a slit penetrating from a front to a back is formed at a position to which the inner peripheral recess or the outer peripheral recess corresponds, between the first member and the second member.

DESCRIPTION OF EMBODIMENTS

A machined article machined by an electric press machine according to an embodiment of the present invention will be described with reference to the drawings. The drawings described below are schematic diagrams and may be different from actual shapes, dimensions, or arrangement.

Figure 1:
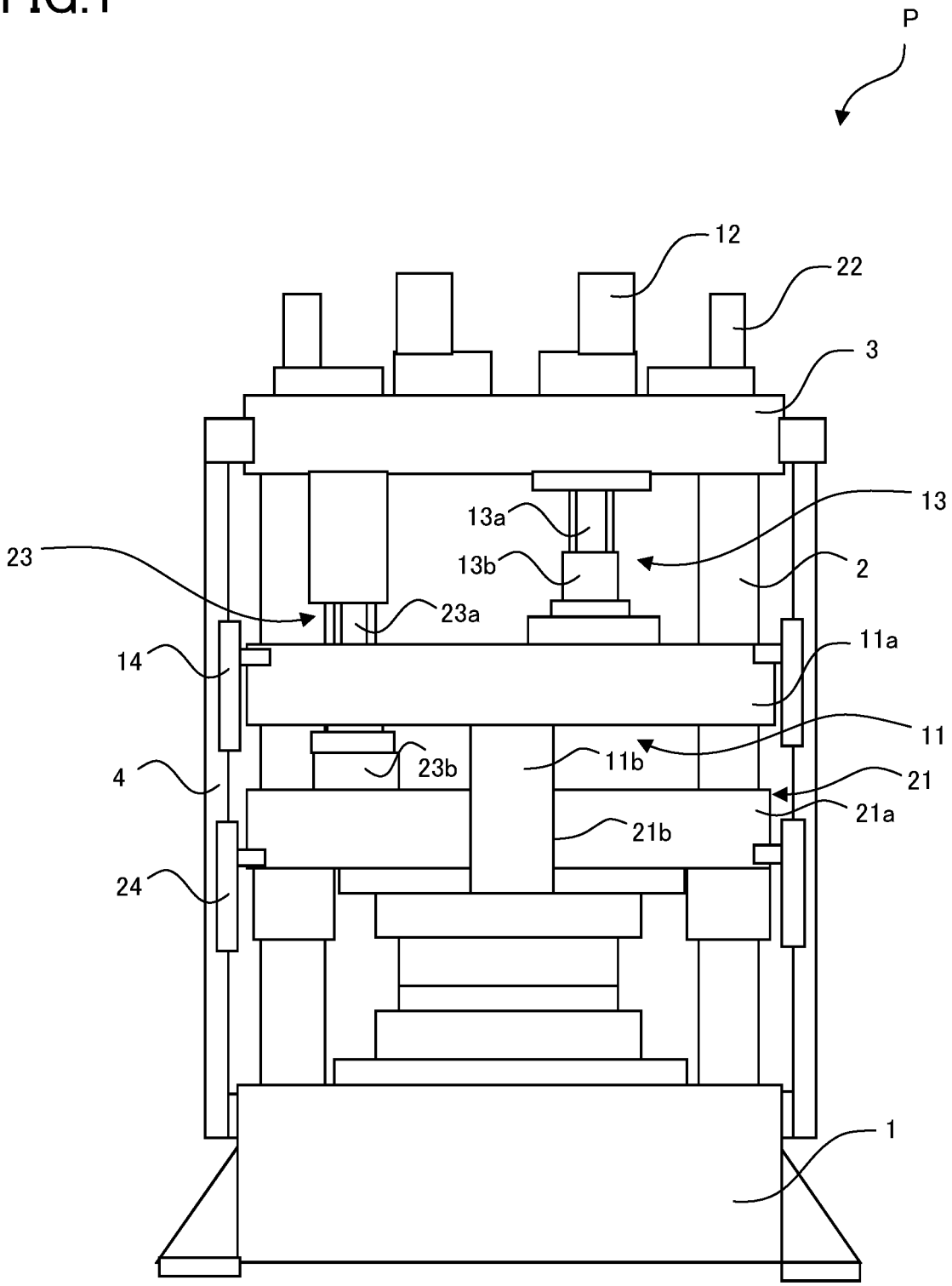
FIG. 1 is a diagram illustrating a configuration of an embodiment of an electric press machine.
Figure 2:
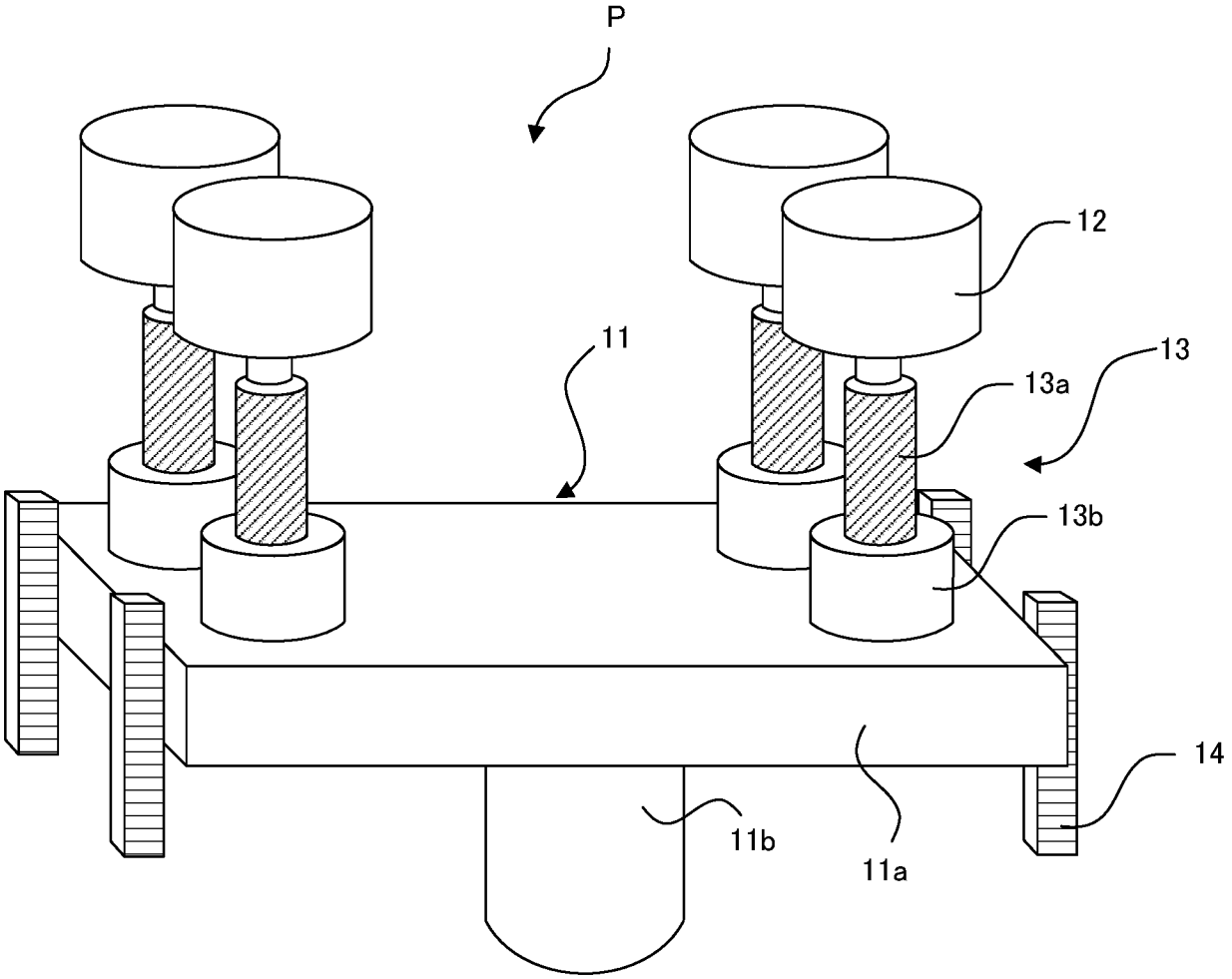
FIG. 2 is a schematic diagram of an inner slide mechanism of the electric press machine.

FIG. 1 is a diagram illustrating an embodiment of an electric press machine P for pressing a machined article. FIG. 2 is a schematic diagram of an inner slide mechanism of the electric press machine. In FIG. 2, supports 2, a crown 3, and outer motors 22 are omitted. An outer slide mechanism has a similar structure to that of the inner slide mechanism.

FIG. 1 illustrates a bed 1, the supports 2, the crown 3, scale columns 4, an inner slide 11 serving as a first slide, inner motors 12 serving as first-side driving sources, inner ball screws 13 serving as first-side feed members, inner position detection members 14 serving as first-side position detection members, an outer slide 21 serving as a second slide, outer motors 22 serving as second-side driving sources, outer ball screws 23 serving as second-side feed members, and outer position detection members 24 serving as second-side position detection members.

The bed 1 is a member serving as a base for placing the electric press machine P on the ground. The supports 2 are columns extending upward from the bed 1. In the present embodiments, there are four supports 2 which are arranged at the respective four corners of the bed 1. The crown 3 is placed on the supports 2, and the inner motors 12 and the outer motors 22 are placed thereon. The bed 1, the supports 2, and the crown 3 form a frame of the electric press machine. The supports 2 are not limited to four in number. At least two or more supports 2 can be provided to support the crown 3. The supports 2 are not limited to column-shaped ones and may be plate-shaped ones.

The inner slide 11 includes a table-like portion 11*a* which is movably attached to the supports 2, and a protrusion 11*b* which extends downward from the table-like portion 11*a*. In the present embodiment, the four corners of the table-like portion 11*a* are slidably arranged on the supports 2, and the protrusion 11*b* is arranged to extend downward from the center of the table-like portion 11*a*. A plurality of protrusions 11*b* may be extended from the table-like portion 11*a*.

The inner motors 12 are placed on the crown 3 and drive the inner ball screws 13. As illustrated in FIG. 2, the inner ball screws 13 each include a screw shaft 13*a* and a nut portion 13*b*. The screw shafts 13*a* are passed through the crown 3 and coupled to the output shafts of the inner motors 12. The nut portions 13*b* are attached to the inner slide 11, and include non-illustrated circulating steel balls inside.

In the present embodiment, there are four inner motors 12 and four inner ball screws 13 corresponding to the four corners of the crown 3 and the inner slide 11. The four inner motors 12 and the four inner ball screws 13 each operate independently. Neither the inner motors 12 nor the inner ball screws 13 are limited to four in number. There may be at least two or more inner motors 12 and two or more inner ball screws 13.

The inner position detection members 14 may preferably be linear scales or the like for reading the scale columns 4 to measure the height at which the inner slide 11 is located with respect to the bed 1. In the present embodiment, there are four inner position detection members 14 corresponding to the four corners of the inner slide 11. There may be at least two or more inner position detection members 14.

The outer slide 21 includes a table-like portion 21*a* which is movably attached to the supports 2 under the inner slide 11, and a hole portion 21*b* through which the protruded portion 11*b* of the inner slide 11 is movably passed in an up-and-down direction of the table-like portion 21*a*. In the present embodiment, the four corners of the table-like portion 21*a* are slidably arranged on the supports 2. The hole portion 21*b* is provided in the center of the table-like portion 21*a* so that the protrusion 11*b* of the inner slide 11 is slidably passed through.

The outer motors 22 are placed on the crown 3 and drive the outer ball screws 23. The outer ball screws 23 each include a screw shaft 23*a* and a nut portion 23*b*. The screw shafts 23*a* are passed through the crown 3 and the inner slide 11, and coupled to the output shafts of the outer motors 22. The nut portions 23*b* are attached to the outer slide 21, and include non-illustrated circulating steel balls inside.

In the present embodiment, there are four outer motors 22 and four outer ball screws 23 corresponding to the respective four corners of the crown 3 and the outer slide 21. The four outer motors 22 and the four outer ball screws 23 each operate independently. Neither the outer motors 22 nor the outer ball screws 23 are limited to four in number. There may be at least two or more outer motors 22 and two or more outer ball screws 23.

The outer position detection units 24 may preferably be linear scales or the like for reading the scale columns 4 to measure the height at which the outer slide 21 is located with respect to the bed 1. In the present embodiment, there are four outer position detection units 24 corresponding to the four corners of the outer slide 21. There may be at least two or more outer position detection units 24.

The scale columns 4 are perpendicularly attached to the bed 1 at one end and to the crown 3 at the other end each. In the present embodiment, the scale columns 4 are attached to the four outer corners of the inner slide 11 and the outer slide 21. The inner position detection units 14 and the outer position detection units 24 use the scale columns 4 in common. The scale columns 4, the inner position detection units 14, and the outer position detection units 24 are therefore provided in the same numbers.

In the present embodiment, an operation of pressing an article to be molded is automatically repeated. During an actual pressing period, the inner slide 11 and the outer slide 21 can be precisely maintained in a horizontal state at each stage of each pressing operation.

More specifically, at each stage while each single shot of pressing in a teaching machining period prior to the actual pressing period is in progress, (i) measurement results of the inner position detection units 14 are obtained and driving energy to be supplied to each of the four inner motors 12 for driving the inner slide 11 is adjusted and determined so that the inner slide 11 can be maintained to be horizontal, and information about the driving energy to be supplied to each of the inner motors 12 at each stage is stored into a storage device, and (ii) measurement results of the outer position detection units 24 are obtained and driving energy to be supplied to each of the four outer motors 22 for driving the outer slide 21 is adjusted and determined so that the outer slide 21 can be maintained to be horizontal, and information about the driving energy to be supplied to each of the outer motors 21 at each stage is stored into the storage device.

Then, at each stage while each single shot of pressing in the actual machining period is in progress, (i) each of the inner motors 12 for driving the inner slide 11 is supplied with driving energy based on the stored information, and (ii) each of the outer motors 22 for driving the outer slide 21 is supplied with driving energy based on the stored information.

In the present embodiment, such control is performed to precisely maintain the inner slide 11 and the outer slide 21 in a horizontal state even at each stage of each pressing operation. As a result, clearances between the sliding holes in the four corners of the slide 11 and the supports 2 can be determined to be 0.10 mm to 0.25 mm.

Figure 3:
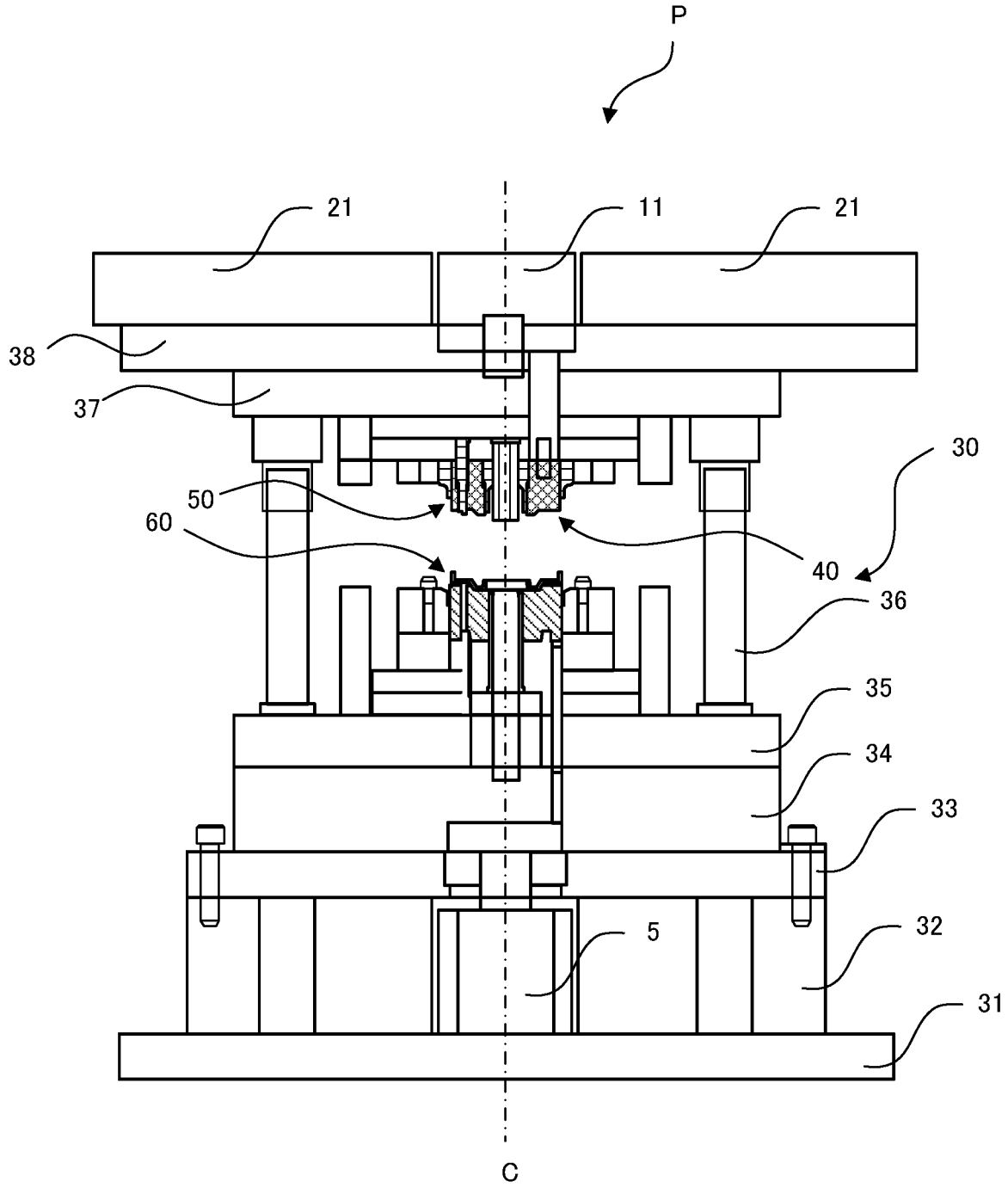
FIG. 3 is a diagram illustrating the vicinity of a die set unit of the electric press machine.

FIG. 3 is a diagram illustrating the vicinity of a die set unit of the electric press machine.

The die set unit 30 is arranged on the bed 1 of the electric press machine P illustrated in FIG. 1. The die set unit 30 includes a lower sub plate 31 which is arranged above the bed 1, leg portions 32 which extend upward from the lower sub plate 33, a lower spacer plate 33 which is arranged on the leg portions 33, a lower spacer 34 which is arranged on the lower spacer plate 33, a lower die set 35 which is arranged on the lower spacer 34, guide posts 36 which extend upward from the four corners of the lower die set 35, an upper die set 37 having engagement holes with which the guide posts 36 are movably engaged, and an upper sub plate 38 which is arranged on the upper die set 37. A hydraulic cushion 5 which can control cushioning force by controlling a valve or the like is also arranged on the lower sub plate 31.

An inner upper die unit 40 is moved by the inner slide 11. An outer upper die unit 50 is moved by the outer slide 21. A first lower die unit 60 is placed on the lower die set 35.

Figure 4:
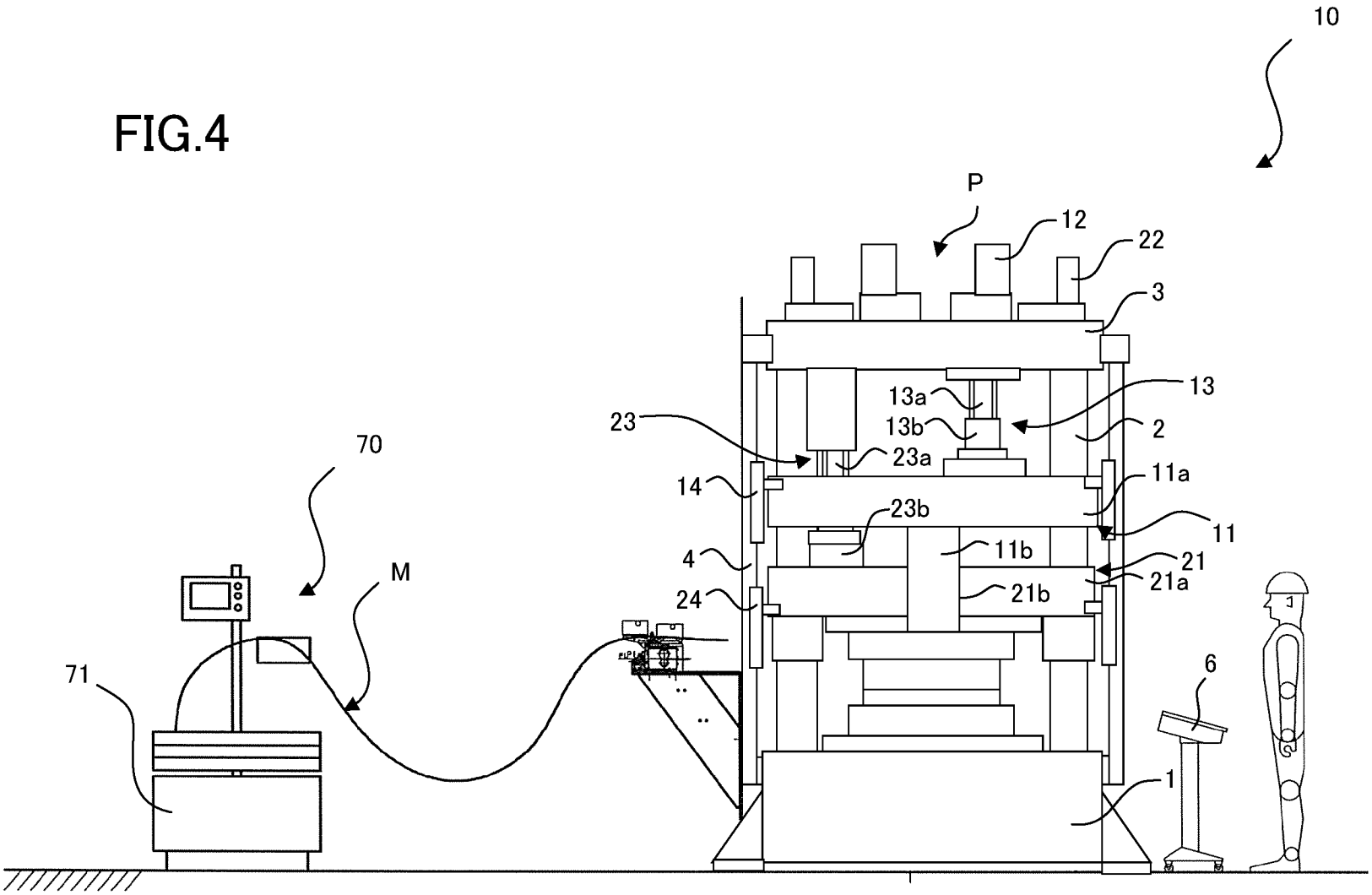
FIG. 4 is a diagram illustrating an electric press system according to a first embodiment.

FIG. 4 is a diagram illustrating an electric press system according to the first embodiment.

An electric press system 10 includes the electric press machine P and a material installation unit 70.

The material installation unit 70 is a section in which a material M yet to be machined is installed. The material installation unit 70 according to the present embodiment uses a disk around the outer periphery of which the material M yet to be machined is wound in a coil form.

The electric press system 10 may include a non-illustrated machining unit that machines part of the material M fed from the material installation unit 70 in advance before being machined by the electric press machine P. The machining unit is a unit for machining the material M fed from the material installation unit 70. Like the technique described in Patent Literature 1, the machining unit machines the material M in a progressive manner. The machine in the machining unit is not limited to a press machine, and may include a cutter or other machine. A plurality of electric press machines P may be used in a row.

Figure 5:
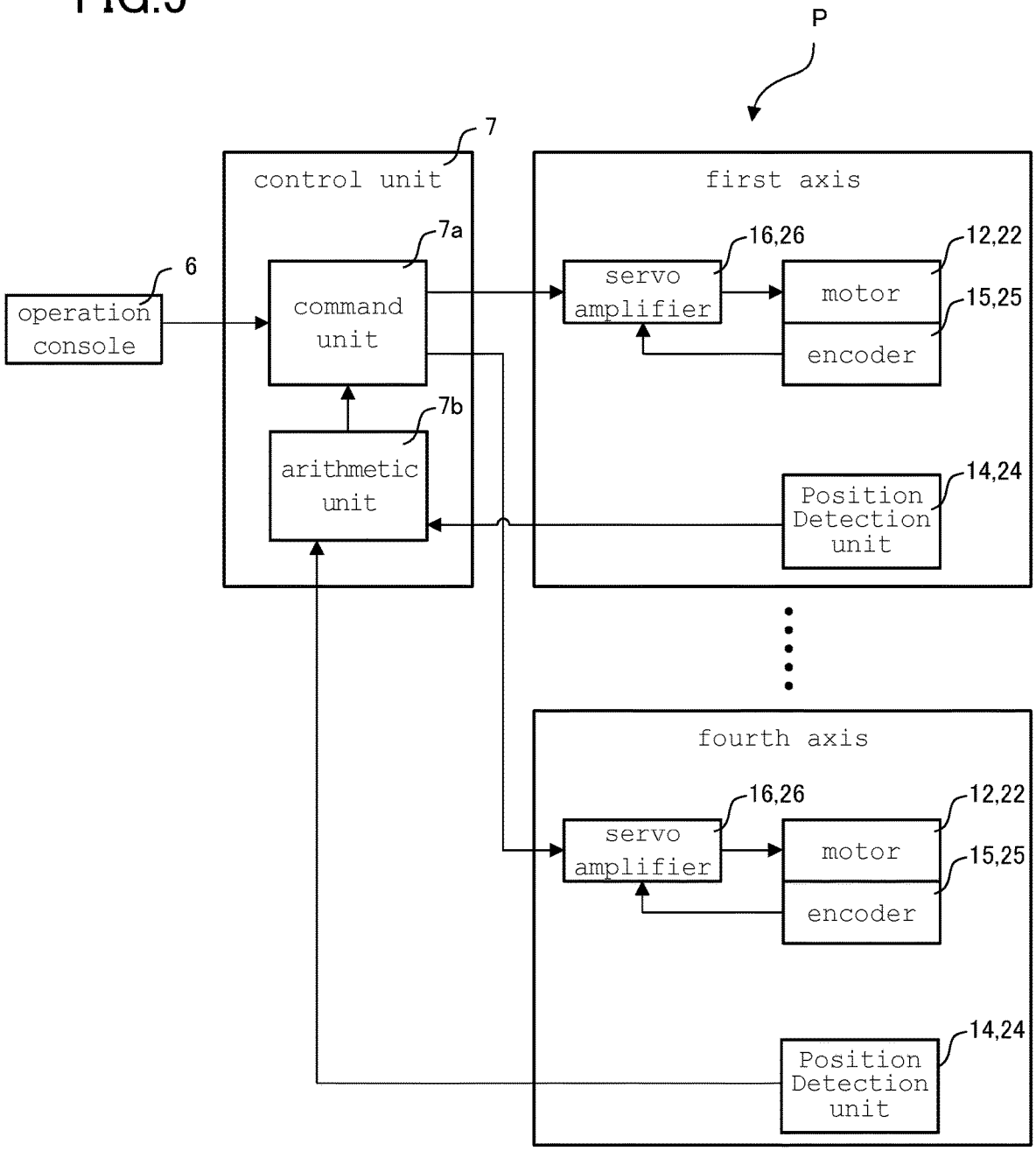
FIG. 5 is a diagram illustrating a system configuration of an electric press machine according to the first embodiment.

FIG. 5 is a diagram illustrating a system configuration of the electric press machine according to the first embodiment.

The electric press machine P includes an operation console 6 which is operated by an operator, and a control unit 7 which drives and controls the inner motors 12 and the outer motors 22 of first to fourth axes according to commands from the operation console 6.

The electric press machine P also includes, corresponding to the respective axes, inner servo amplifiers 16 and outer servo amplifiers 26 which receive signals from the control unit 7 and drive and control the inner motors 12 and the outer motors 22, inner encoders 15 and outer encoders 25 which detect the numbers of rotations of the inner motors 12 and the outer motors 22, and the inner position detection units 14 and the outer position detection units 24 which detect the positions of the respective axes.

The control unit 7 includes a command unit 7*a* which gives commands about positions to the servo amplifiers 16 and 26 corresponding to the respective axes, and an arithmetic unit 7*b* which calculates command values from the detection values of the position detection units 14 and 24.

Next, a machined article to be machined by the electric press machine will be described. As employed herein, the upper surface of a machined article during pressing will be referred to as the front, and the lower surface the back.

Figure 6:
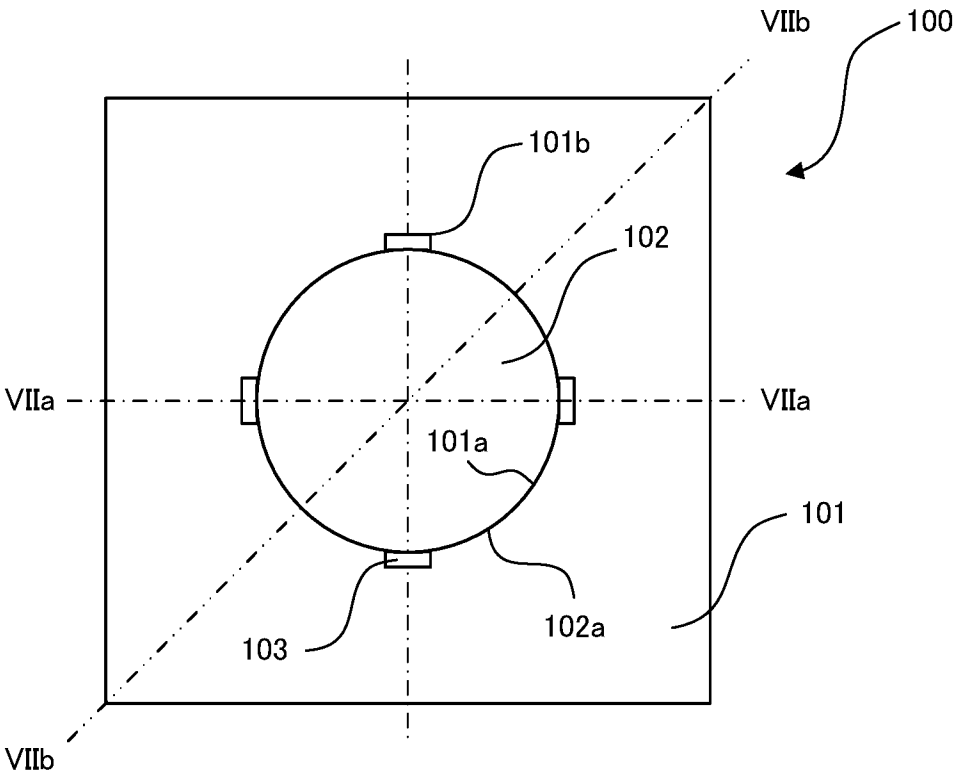
FIG. 6 illustrates a machined article according to the first embodiment.
Figure 7A:
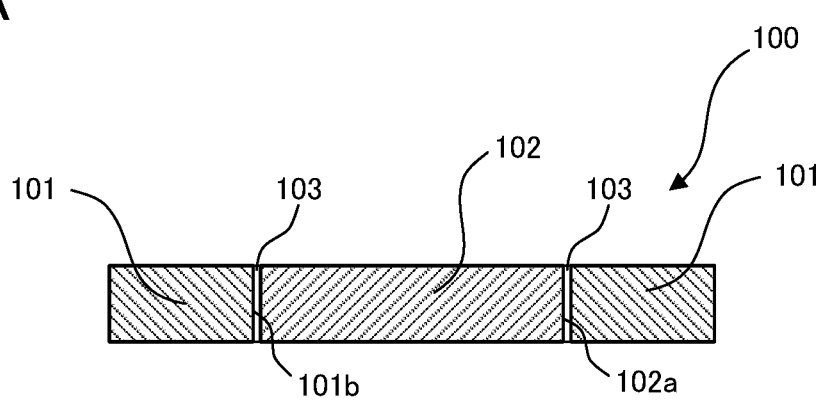
FIGS. 7A and 7B illustrate sectional views taken along lines VII-VII of FIG. 6.
Figure 7B:
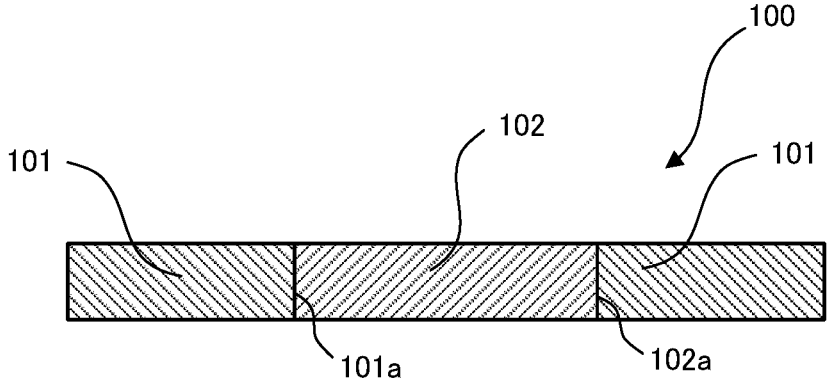

FIG. 6 illustrates a machined article according to the first embodiment. FIGS. 7A and 7B illustrate sectional views taken along lines VII-VII of FIG. 6. FIG. 7A illustrates a VIIa-VIIa section of FIG. 6. FIG. 7B illustrates a VIIb-VIIb section of FIG. 6.

As illustrated in FIG. 6, a machined article 100 according to the first embodiment includes a first member 101 and a second member 102.

The first member 101 includes an inner peripheral portion 101*a* which is formed by perforation, and inner peripheral recesses 101*b* which are dented radially outward from the inner peripheral portion 101*a*. The second member 102 includes an outer peripheral portion 102*a* which is formed by pressing. The outer peripheral portion 102*a* of the second member 102 has the same shape as that of the inner peripheral portion 101*a* of the first member 101.

Consequently, the machined article 100 which is formed by fitting the second member 102 into the first member 101 forms slits 103 penetrating from the front to the back at positions to which the inner peripheral recesses 101*b* correspond, between the first member 101 and the second member 102.

The machined article 100 according to the first embodiment can thus have precisely-machined slits of minute dimensions.

Figure 8:
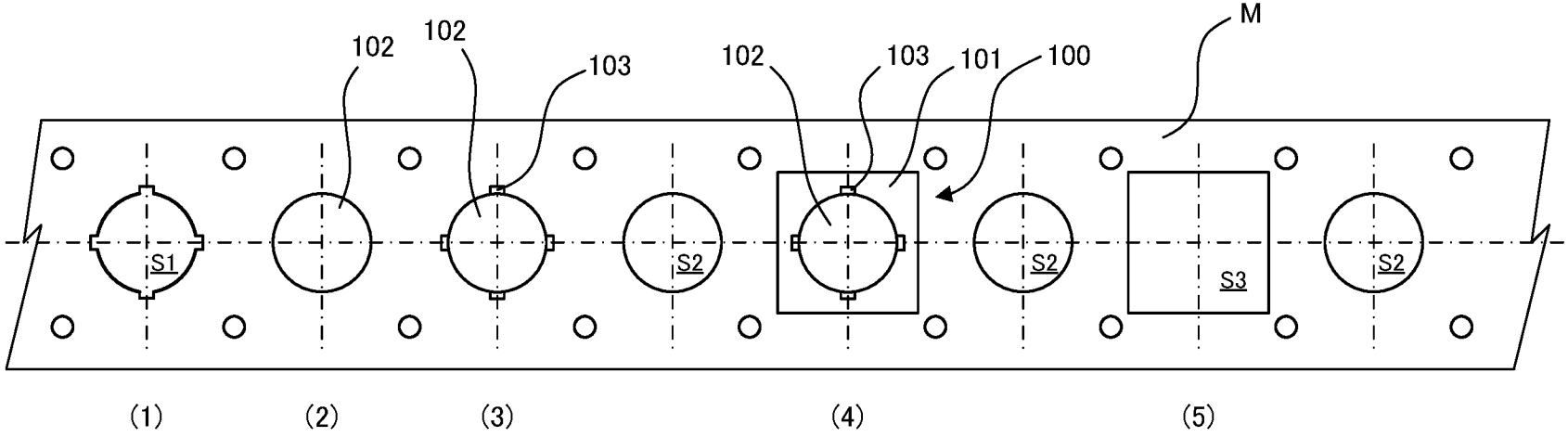
FIGS. 8(1) to 8(5) illustrate a machining method of the machined article according to the first embodiment.
Figure 9A:
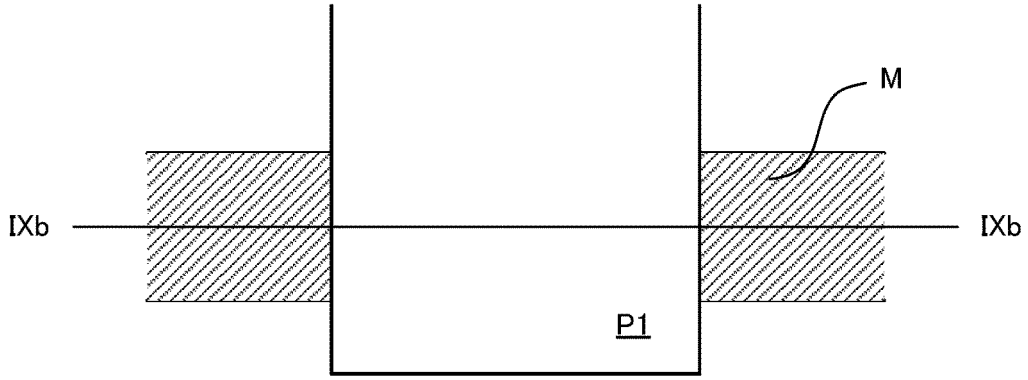
FIGS. 9A and 9B illustrate a step of FIG. 8(1).
Figure 9B:
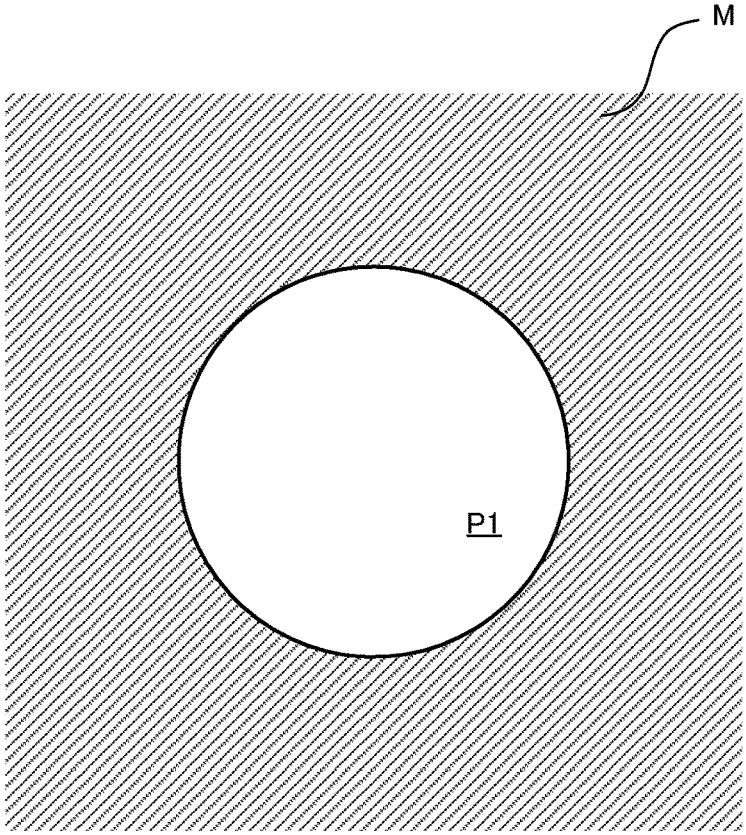
Figure 10A:
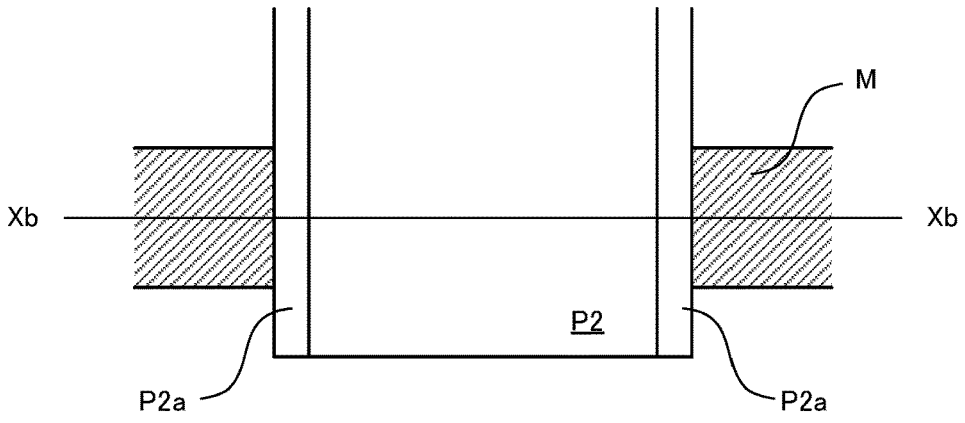
FIGS. 10A and 10B illustrate a step of FIG. 8(1).
Figure 10B:
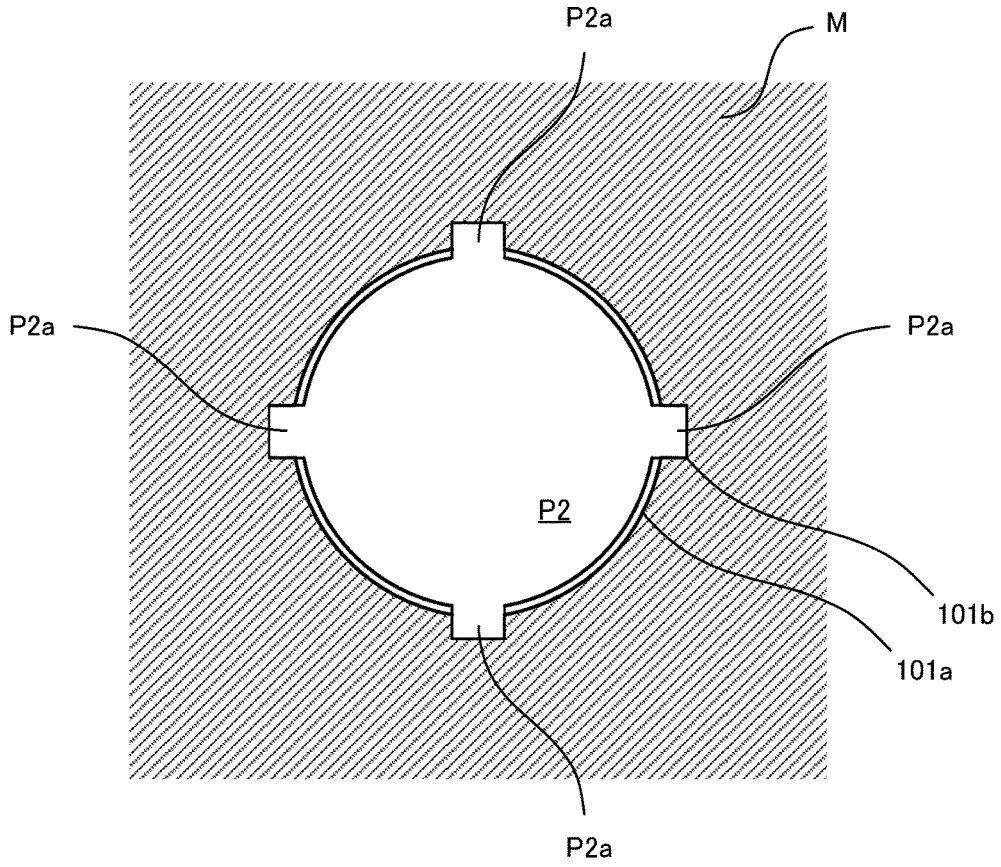
Figure 11A:
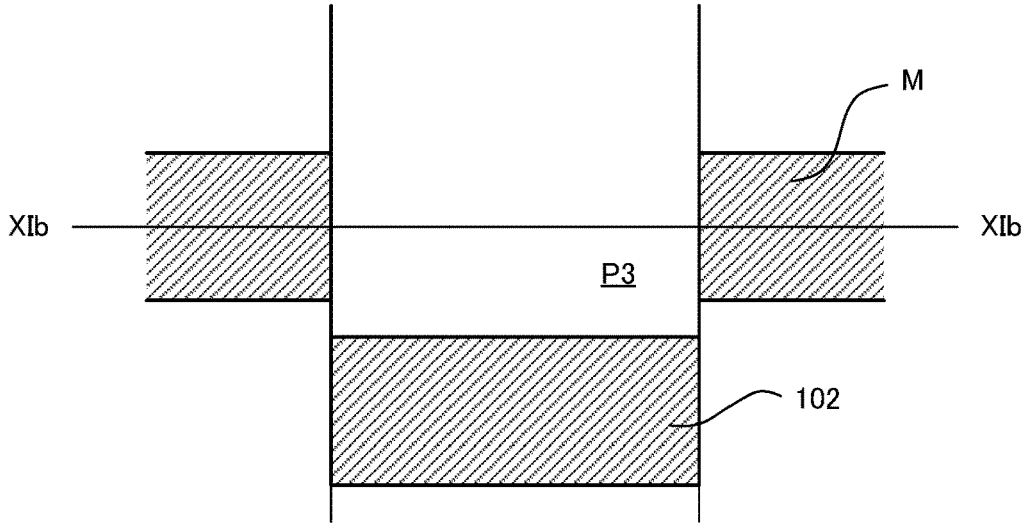
FIGS. 11A and 11B illustrate the step of FIG. 8(2).
Figure 11B:
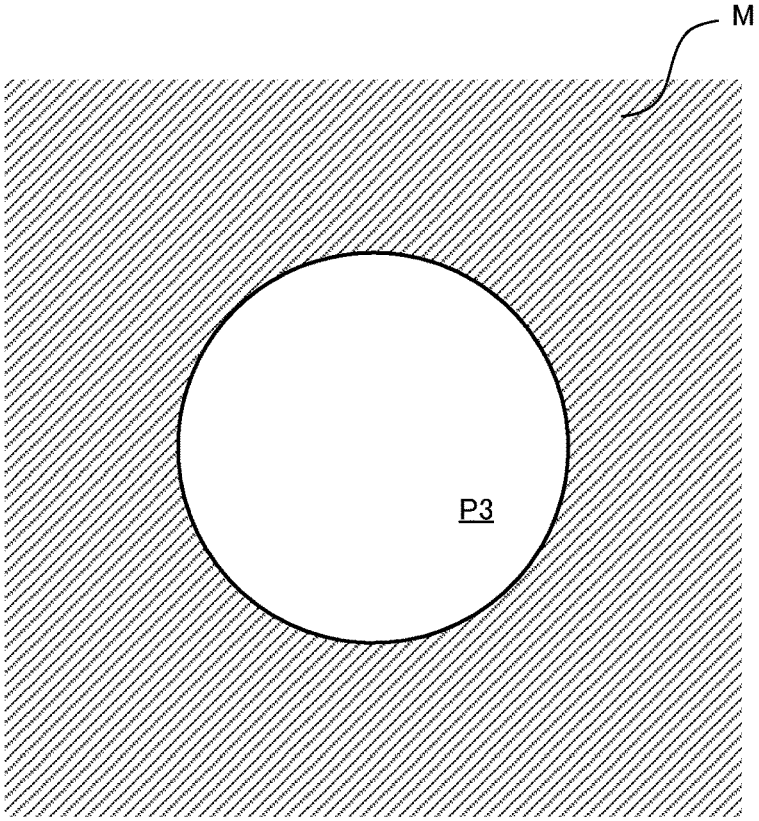
Figure 12A:
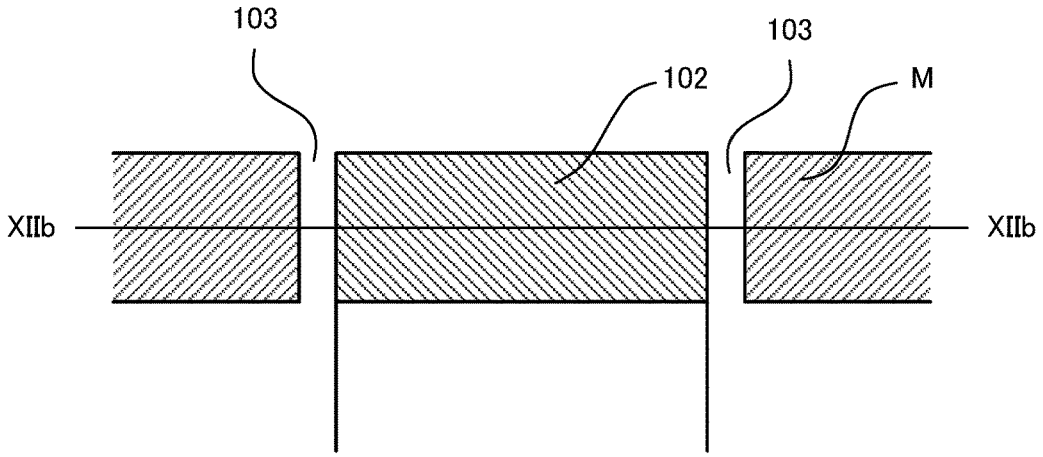
FIGS. 12A and 12B illustrate the step of FIG. 8(3).
Figure 12B:
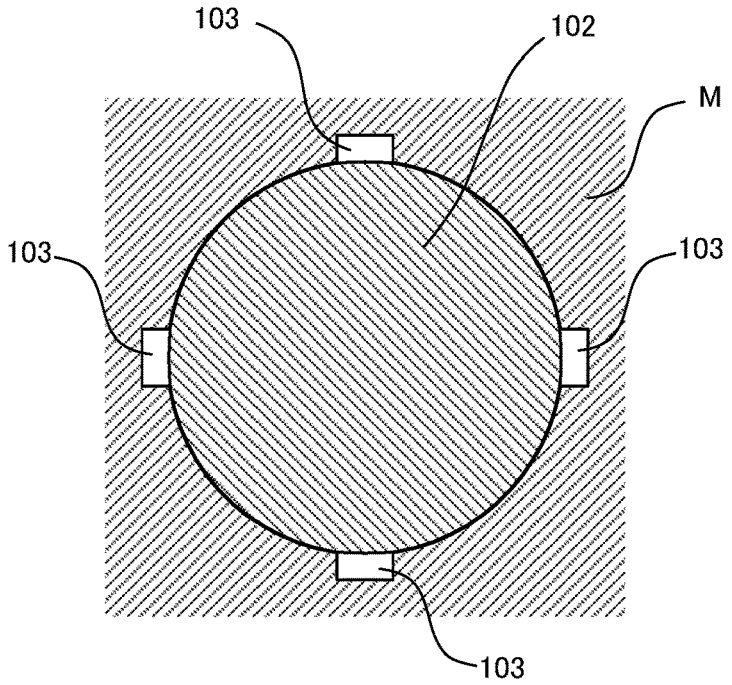
Figure 13A:
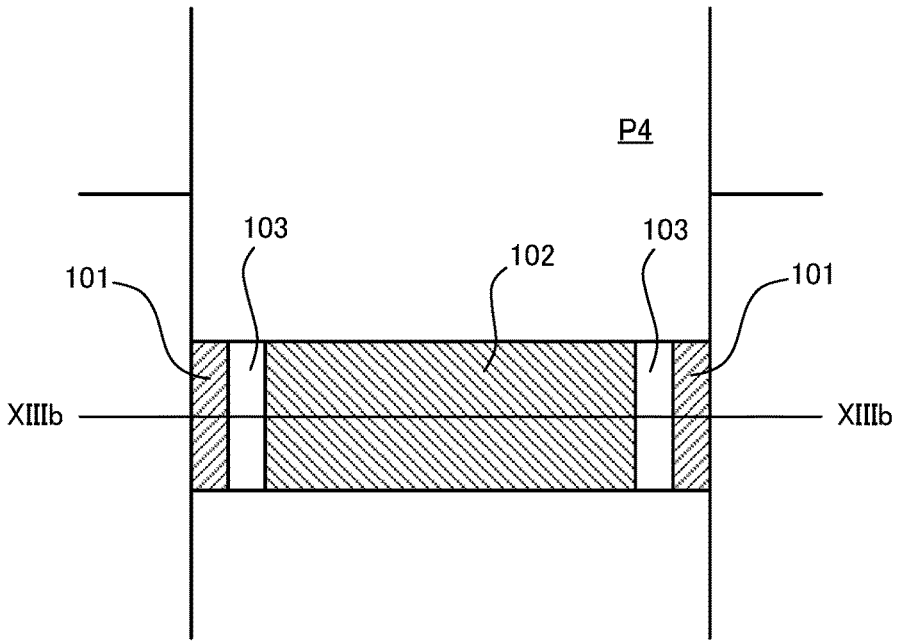
FIGS. 13A and 13B illustrate the step of FIG. 8(4).
Figure 13B:
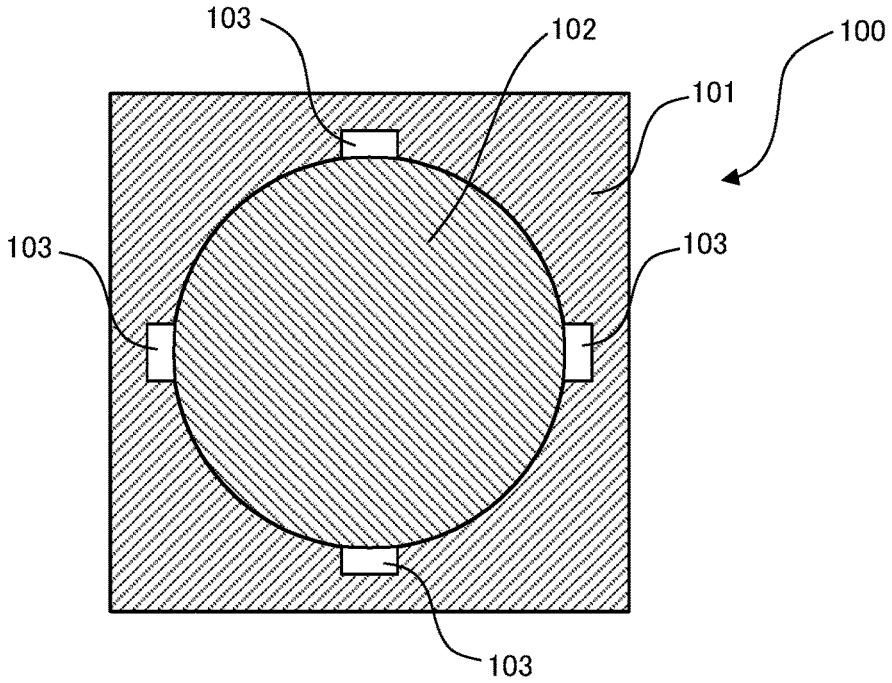

FIGS. 8(1) to 8(5) illustrate a machining method of the machined article according to the first embodiment. FIGS. 9A and 9B illustrate a first step of FIG. 8(1). FIGS. 10A and 10B illustrate a second step of FIG. 8(1). FIGS. 11A and 11B illustrate the step of FIG. 8(2). FIGS. 12A and 12B illustrate the step of FIG. 8(3). FIGS. 13A and 13B illustrate the step of FIG. 8(4).

As illustrated in FIGS. 8(1) to 8(5), the machined article 100 according to the first embodiment is formed by machining a band of material M.

Initially, in the steps of (1) illustrated in FIG. 8, as illustrated in FIGS. 9A and 9B, the material M is circularly pressed by a first punch P1 to form a hole. Next, as illustrated in FIGS. 10A and 10B, part of the inner peripheral portion 101*a* formed by perforation is pressed by protrusions P2*a* of a second punch P2 to form the inner peripheral recesses 101*b* which are dented radially outward. A hole S1 is formed in the punched material M.

Next, in the step of (2) illustrated in FIG. 8, as illustrated in FIGS. 11A and 11B, a second member 102 formed by pressing the material M by a third punch P3 is supported below. The step of (2) may be performed simultaneously with or before the step of (1).

Next, in the step of (3) illustrated in FIG. 8, the hole S1 formed in the step of (1) is moved to above the second member 102 supported below in the step of (2) as illustrated in FIGS. 11A and 11B. As illustrated in FIGS. 12A and 12B, the second member 102 is pressed and fitted into the hole S1 from below.

Finally, as illustrated in FIGS. 13A and 13B, the periphery of the second member 102 fitted in the material M is pressed by a fourth punch P4 to complete the machined article 100.

In such a manner, the pressing method according to the first embodiment can easily and precisely machine the slits of minute dimensions.

Figure 14:
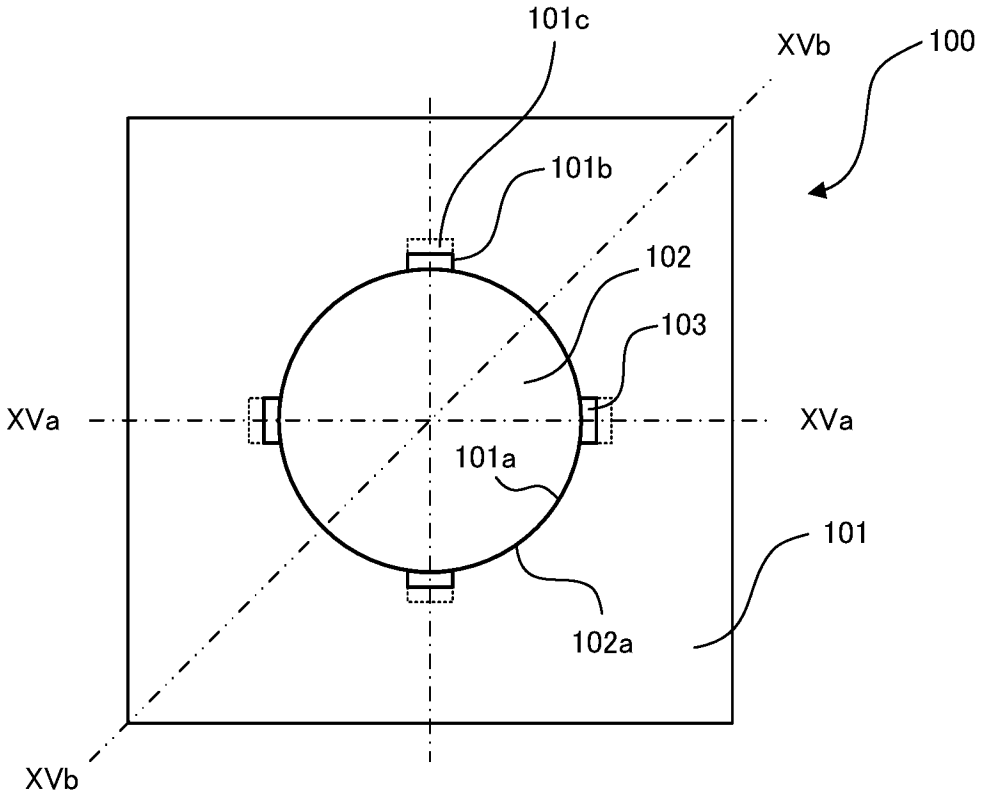
FIG. 14 illustrates the machined article according to the first embodiment.
Figure 15A:
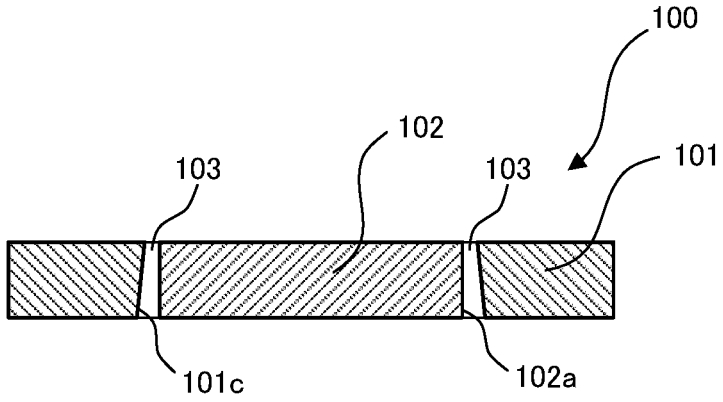
FIGS. 15A and 15B illustrate sectional views taken along lines XV-XV of FIG. 14.
Figure 15B:
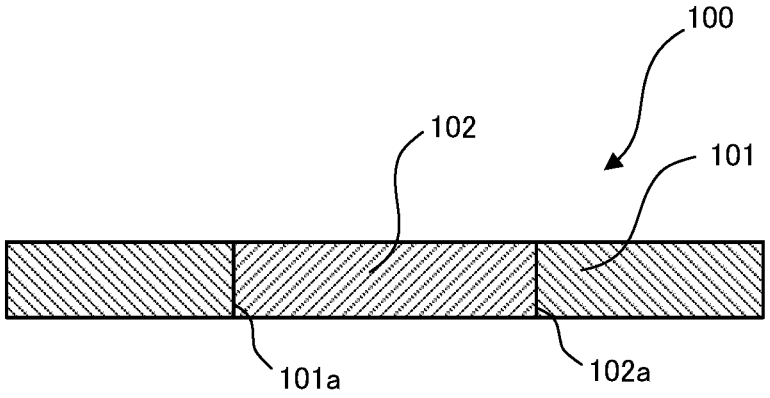

FIG. 14 illustrates a machined article according to a second embodiment. FIGS. 15A and 15B illustrate sectional views taken along lines XV-XV of FIG. 14. FIG. 15A illustrates a XVa-XVa section of FIG. 14. FIG. 15B illustrates a XVb-XVb section of FIG. 14.

As illustrated in FIG. 14, a machined article 100 according to the second embodiment includes a first member 101 and ad second member 102.

The first member 101 includes an inner peripheral portion 101*a* which is formed by perforation, and inner peripheral recesses 101*b* which are dented radially outward from the inner peripheral portion 101*a*. Outer side surfaces 101*c* of the inner peripheral recesses 101*b* at outer sides farthest from the inner peripheral portion 101*a* are obliquely formed in a tapered shape to get away from the inner peripheral portion 101*a* from the front to the back.

The second portion 102 includes an outer peripheral portion 102*a* which is formed by pressing. The outer peripheral portion 102*a* of the second member 102 has the same shape as that of the inner peripheral portion 101*a* of the first member 101.

Consequently, the machined article 100 which is formed by fitting the second member 102 into the first member 101 forms slits 103 penetrating from the front to the back at positions to which the inner peripheral recesses 101*b* correspond, between the first member 101 and the second member 102.

The machined article 100 according to the second embodiment can thus have the precisely-machined slits of minute dimensions. The directions of the slits can be set to increase the degree of freedom of design.

Figure 16:
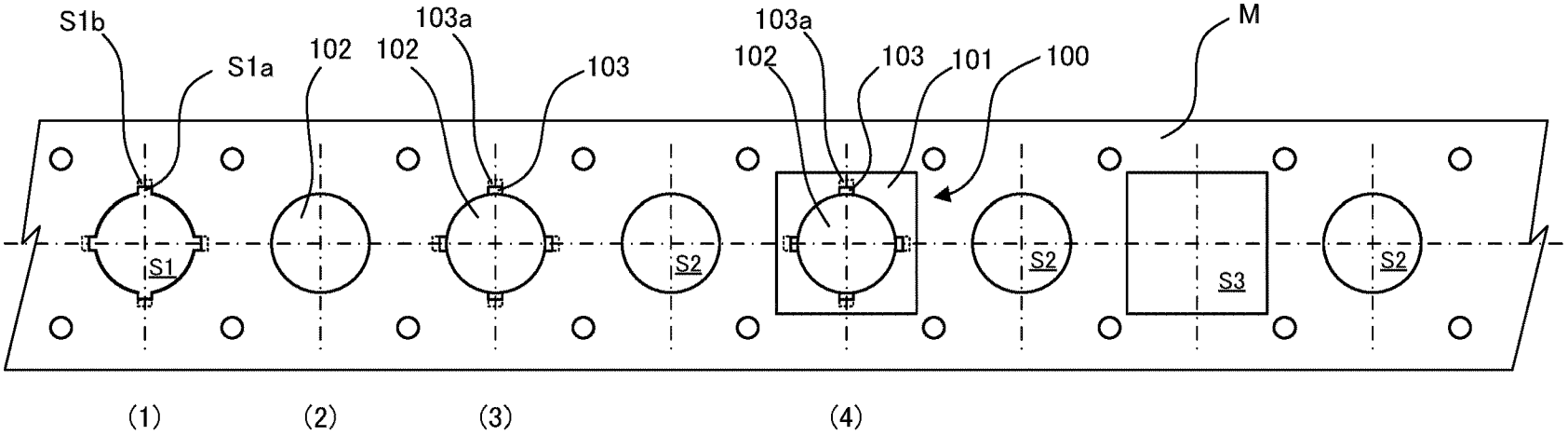
FIGS. 16(1) to 16(4) illustrate a machining method of a machined article according to a second embodiment.
Figure 17A:
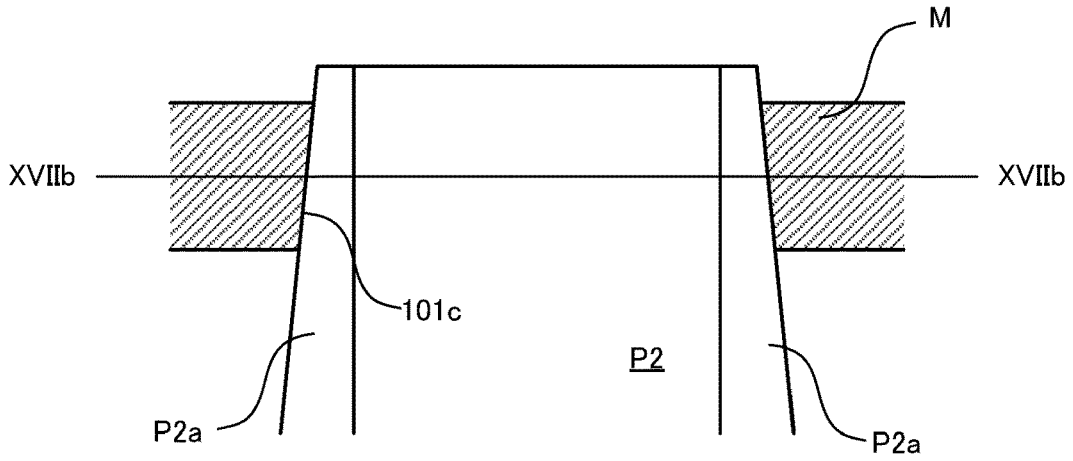
FIGS. 17A and 17B illustrate the step of FIG. 16(1).
Figure 17B:
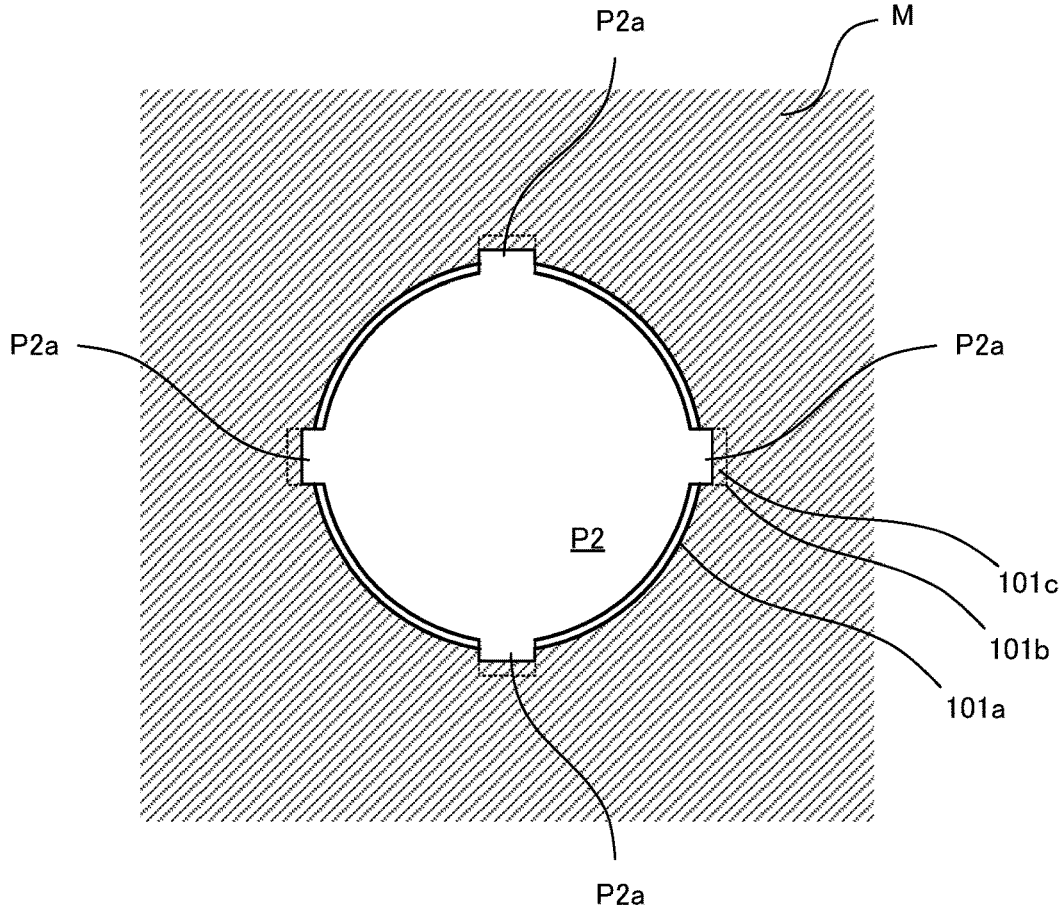
Figure 18A:
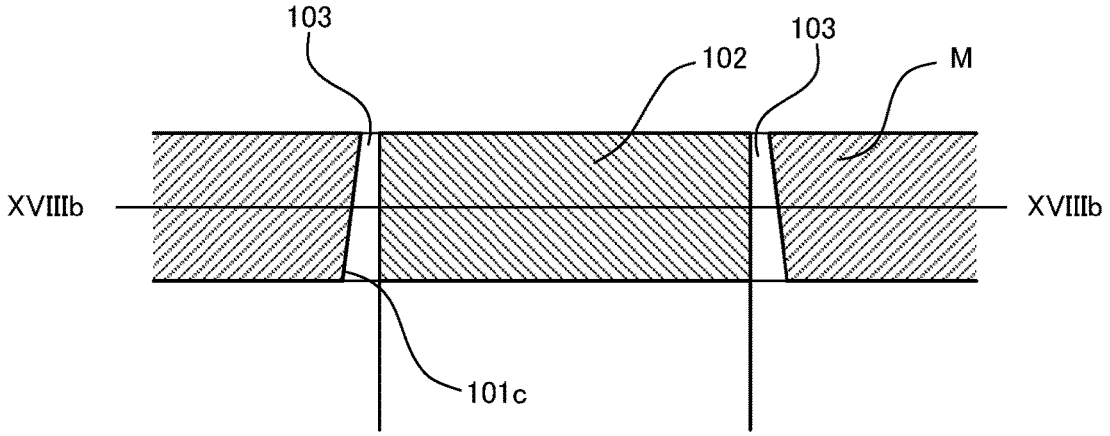
FIGS. 18A and 18B illustrate the step of FIG. 16(3).
Figure 18B:
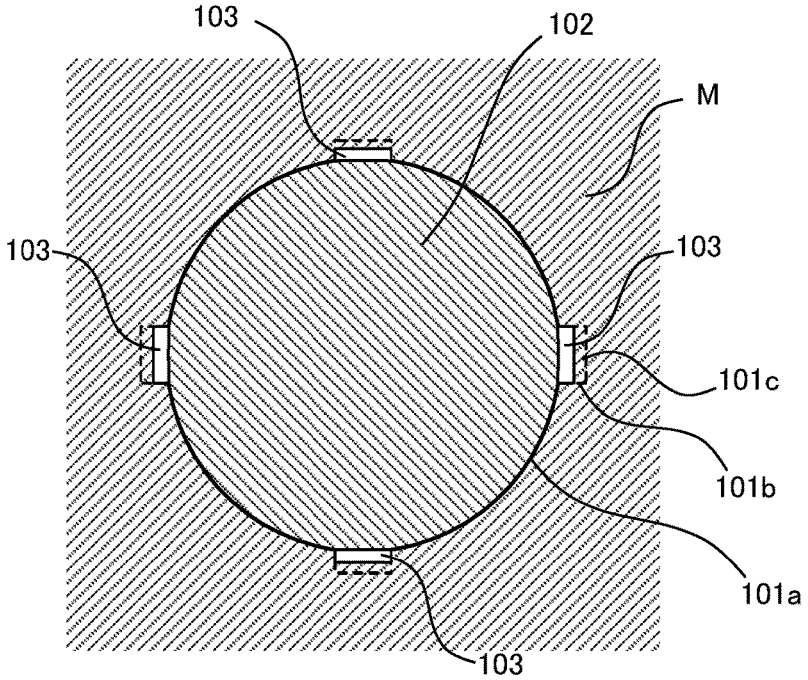
Figure 19A:
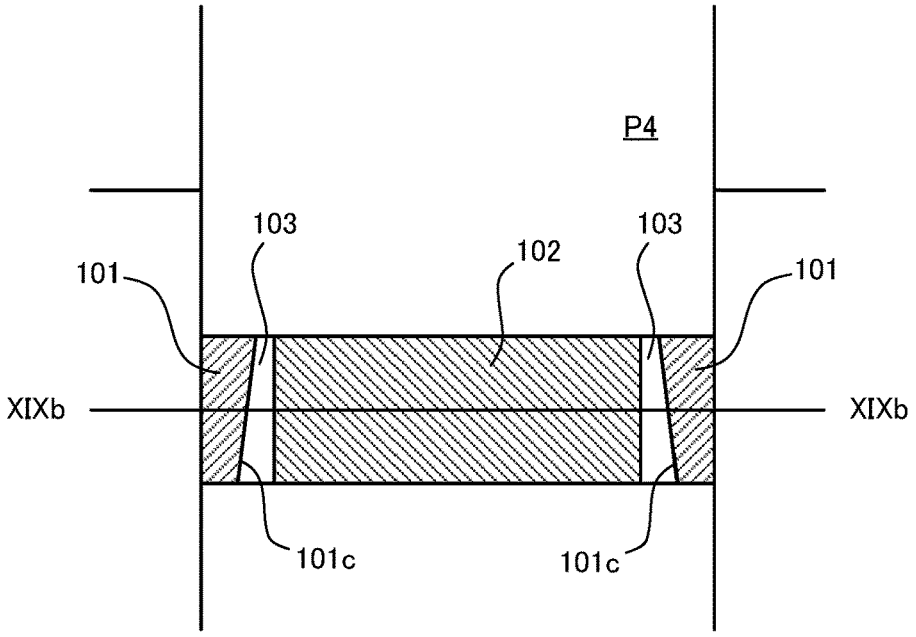
FIGS. 19A and 19B illustrate the step of FIG. 16(4).
Figure 19B:
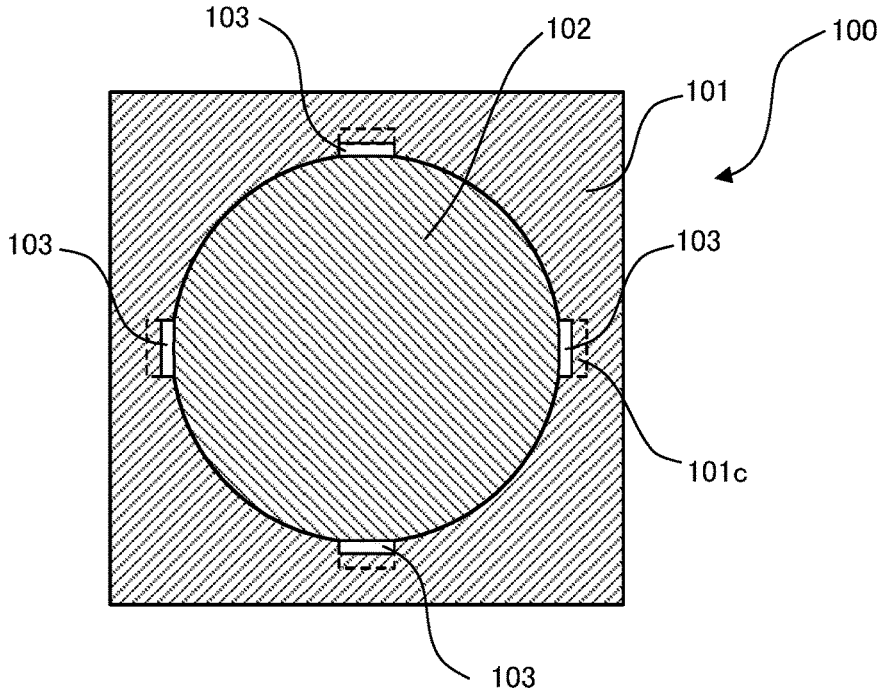

FIGS. 16(1) to 16(4) illustrate a machining method of the machined article according to the second embodiment. FIGS. 17A and 17B illustrate a second step of FIG. 16(1). FIGS. 18A and 18B illustrate the step of FIG. 16(3). FIGS. 19A and 19B illustrate the step of FIG. 16(4).

As illustrated in FIGS. 16(1) to 16(4), the machined article 100 according to the second embodiment is formed by machining a band of material M.

In the step of (1) illustrated in FIG. 16, as illustrated in FIGS. 9A and 9B, the material M is circularly pressed by the first punch P1 to form a hole. Next, as illustrated in FIGS. 17A and 17B, part of the inner peripheral portion 101*a* formed by perforation is pressed by protrusions P2*a* of a second punch P2 to form the inner peripheral recesses 101*b* dented radially outward. Outer side surfaces 101*c* of the inner peripheral recesses 101*a* at outer sides farthest from the inner peripheral portion 101*a* are obliquely formed in a tapered shape to get away from the inner peripheral portion 101*a* from the front to the back. A hole S1 is formed in the punched material M.

Next, in the step of (2) illustrated in FIG. 16, as illustrated in FIGS. 11A and 11B, a second member 102 formed by punching the material M by the third punch P3 is supported below. The step of (2) may be performed simultaneously with or before the step of (1).

Next, in the step of (3) illustrated in FIG. 16, the hole S1 formed in the step of (1) is moved to above the second member 102 supported below in the step of (2) as illustrated in FIGS. 11A and 11B. As illustrated in FIGS. 18A and 18B, the second member 102 is pressed and fitted into the hole S1 from below.

Finally, as illustrated in FIGS. 19A and 19B, the periphery of the second member 102 fitted in the material M is pressed by a fourth punch P4 to complete the machined article 100.

In such a manner, the pressing method according to the second embodiment can easily and precisely machine the slits of minute dimensions. The slits can be easily and precisely machined even if the directions of the slits intersect with the direction of fitting of the second member into the first member.

Figure 20:
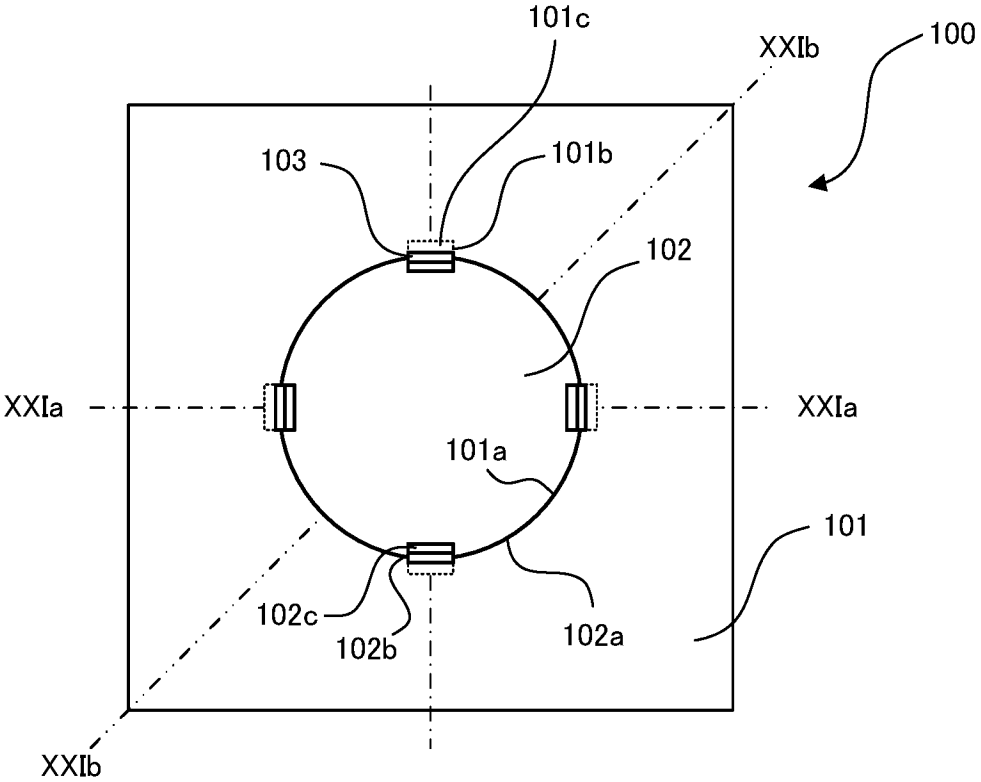
FIG. 20 illustrates a machined article according to a third embodiment.
Figure 21A:
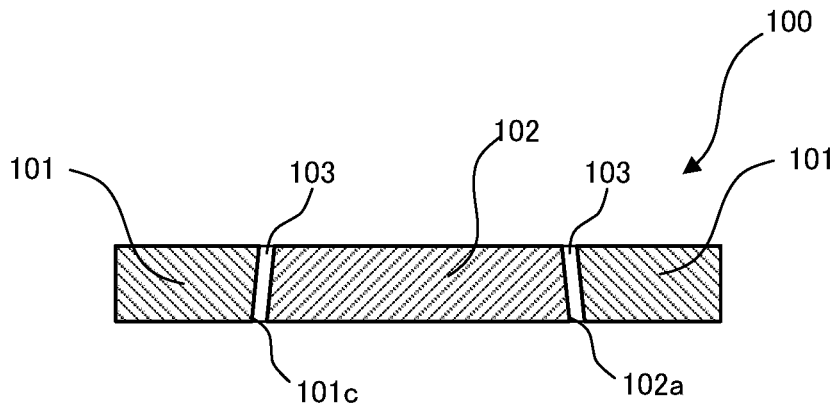
FIGS. 21A and 21B illustrate sectional views taken along lines XXI-XXI of FIG. 20.
Figure 21B:
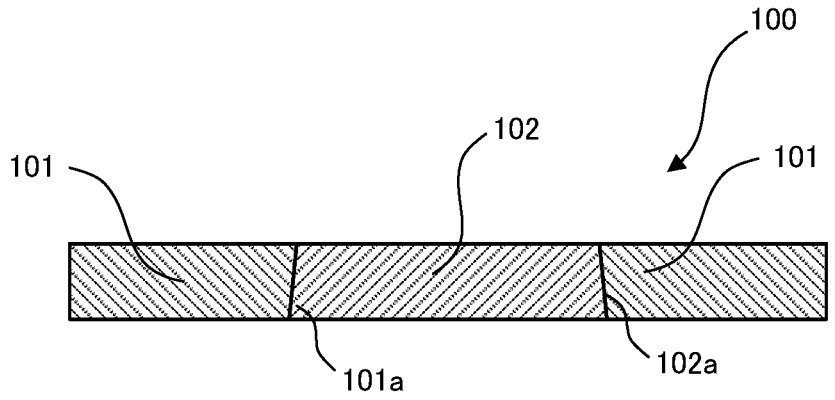

FIG. 20 illustrates a machined article according to a third embodiment. FIGS. 21A and 21B illustrate sectional views taken along lines XXI-XXI of FIG. 20. FIG. 21A illustrates a XXIa-XXIa cross section of FIG. 20. FIG. 21B illustrates a XXIb-XXIb cross section of FIG. 20.

As illustrated in FIG. 20, a machined article 100 according to the third embodiment includes a first member 101 and a second member 102.

The first member 101 includes an inner peripheral portion 101*a* which is formed by perforation, and inner peripheral recesses 101*b* which are dented radially outward from the inner peripheral portion 101*a*. Outer side surfaces 101*c* of the inner peripheral portions 101*b* at outer sides farthest from the inner peripheral portion 101*a* are obliquely formed in a tapered shape to get away from the inner peripheral portion 101*a* from the front to the back.

The second member 102 includes an outer peripheral portion 102*a* which is formed by pressing, and outer peripheral recesses 102*b* which are dented radially inward from the outer peripheral portion 102*a*. Inner side surfaces 102*c* of the outer peripheral recesses 102*b* at inner sides farthest from the outer peripheral portion 102*a* are obliquely formed in a tapered shape to approach the outer peripheral portion 102*a* from the front to the back.

The outer peripheral portion 102*a* of the second member 102 has the same shape as that of the inner peripheral portion 101*a* of the first member 101. The machined article 100 formed by fitting the second member 102 into the first member 101 thus forms slits 103 penetrating from the front to the back at positions to which the inner peripheral recesses 101*b* and the outer peripheral recesses 102*b* correspond, between the first member 101 and the second member 102.

The machined article 100 according to the third embodiment can thus have the precisely-machined slits of minute dimensions. The directions of the slits can be set to increase the degree of freedom of design.

Figure 22:
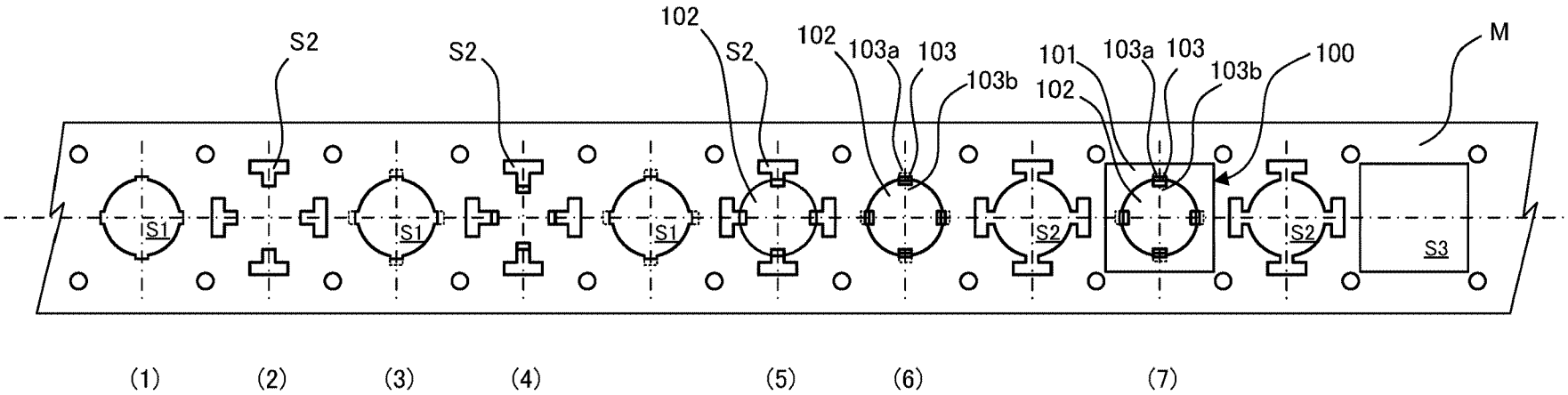
FIGS. 22(1) to 22(7) illustrate a machining method of the machined article according to the third embodiment.
Figure 23A:
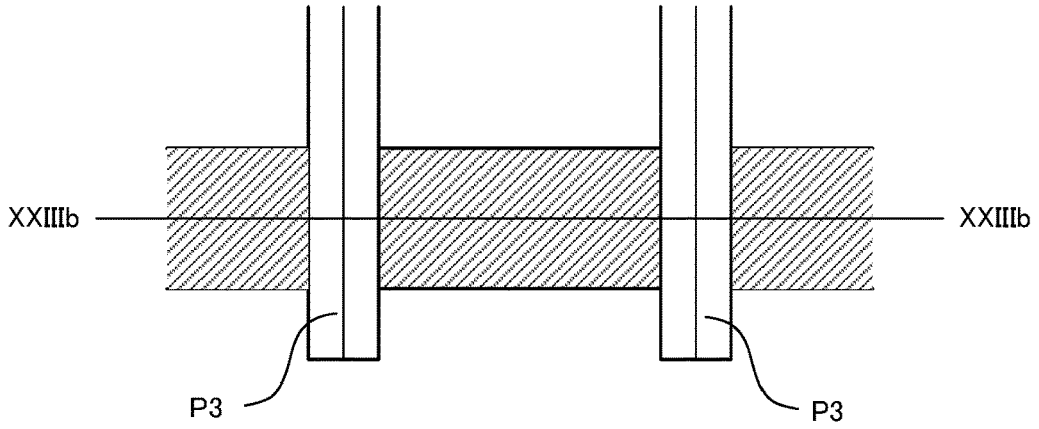
FIGS. 23A and 23B illustrate the step of FIG. 22(2).
Figure 23B:
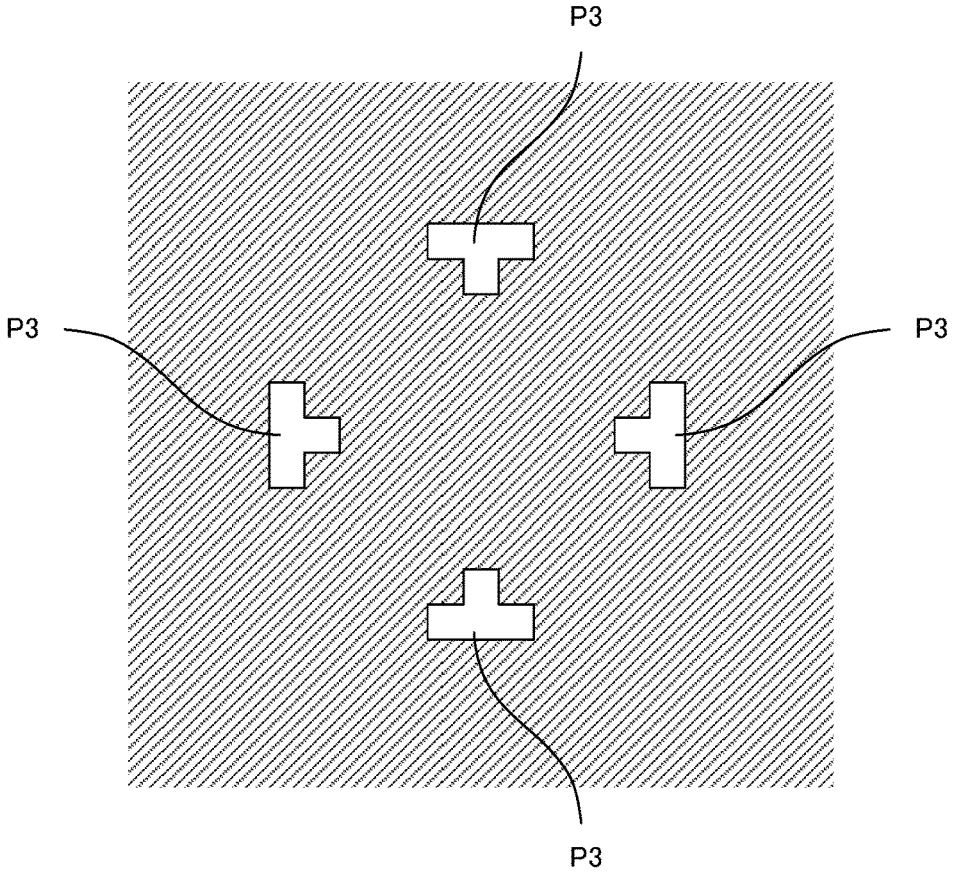
Figure 24A:
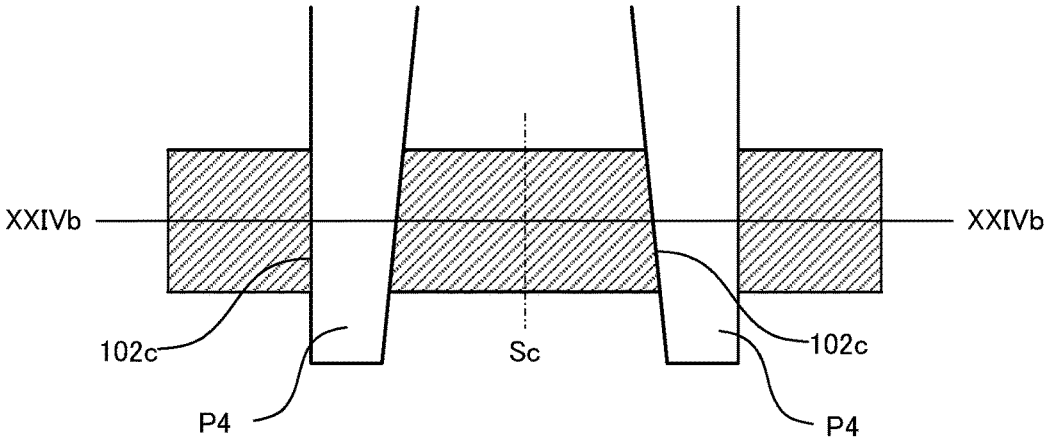
FIGS. 24A and 24B illustrate the step of FIG. 22(4).
Figure 24B:
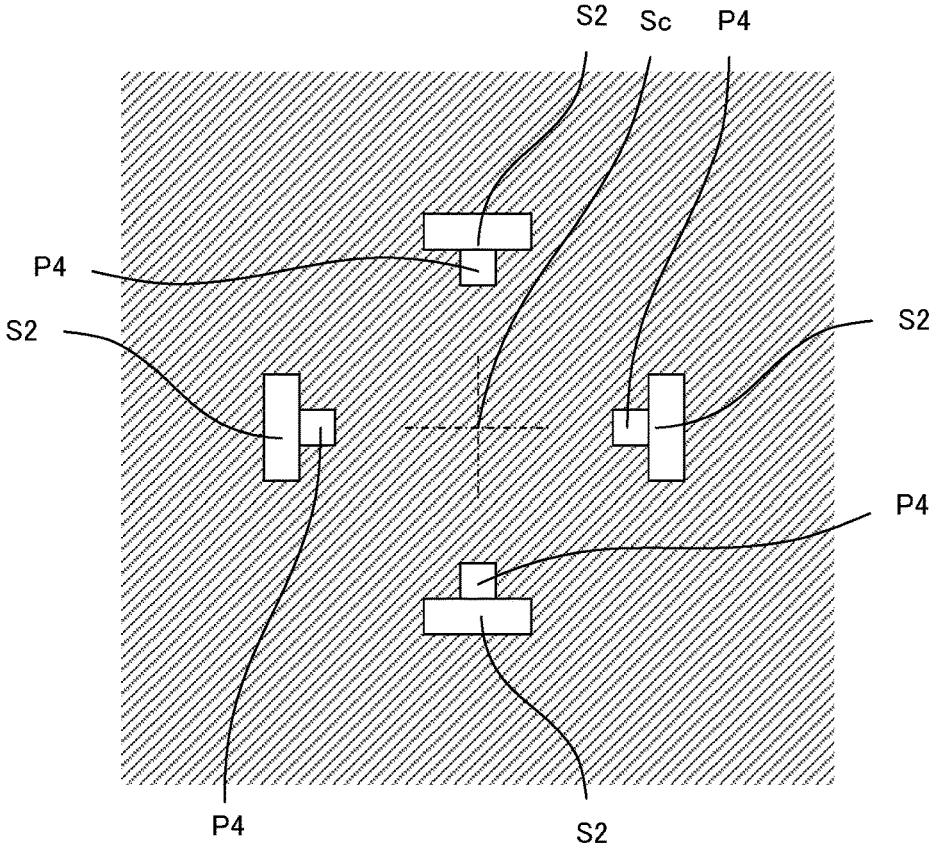
Figure 25A:
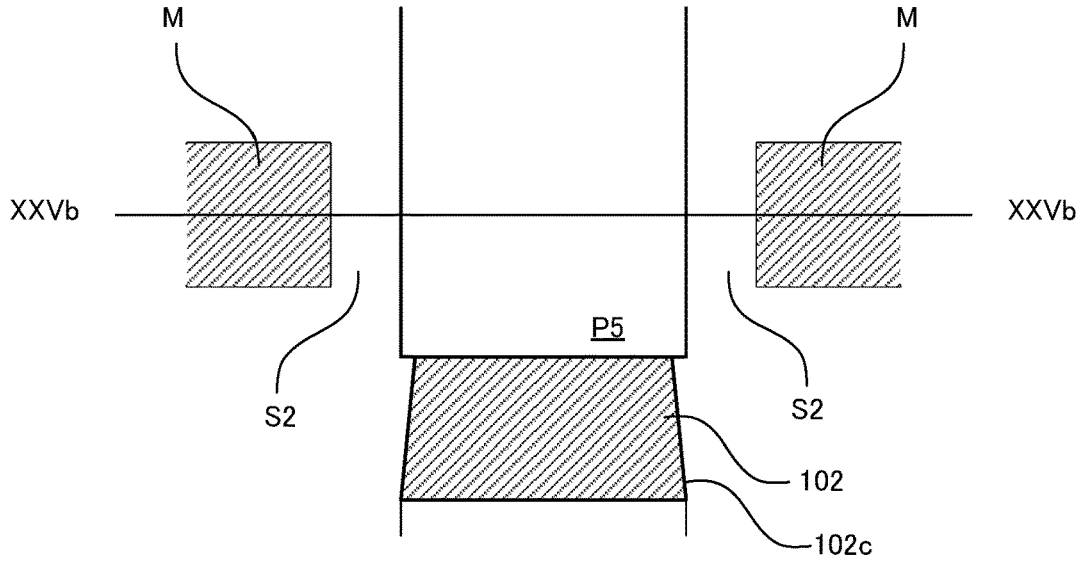
FIGS. 25A and 25B illustrate the step of FIG. 22(5).
Figure 25B:
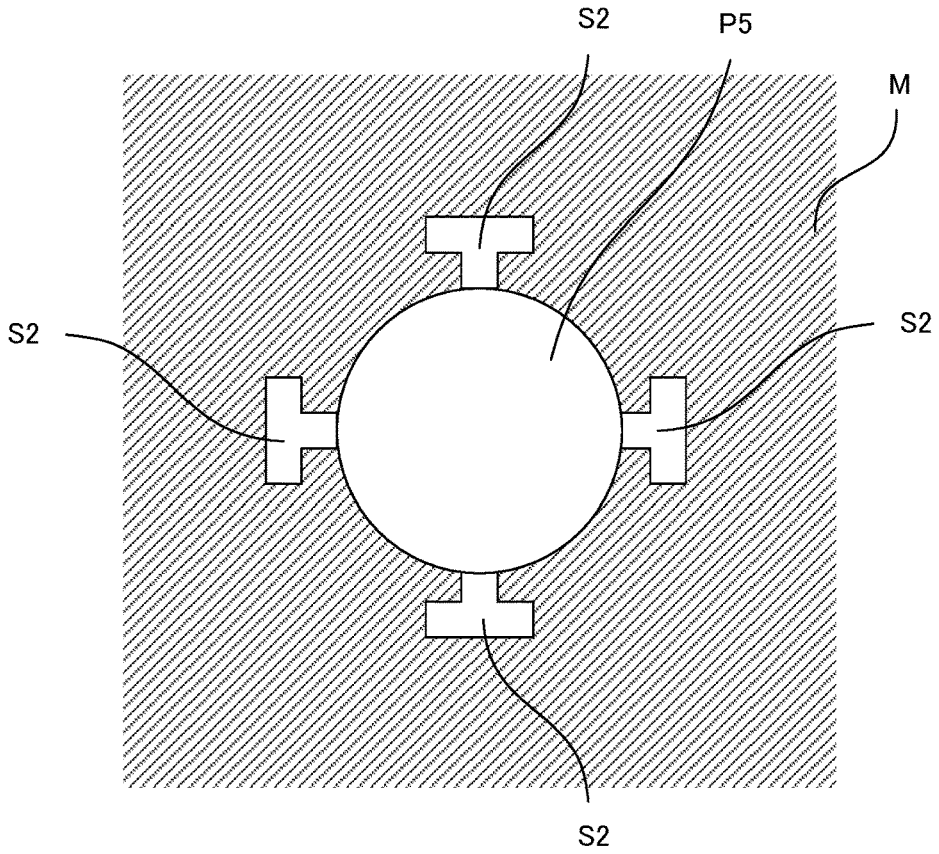
Figure 26A:
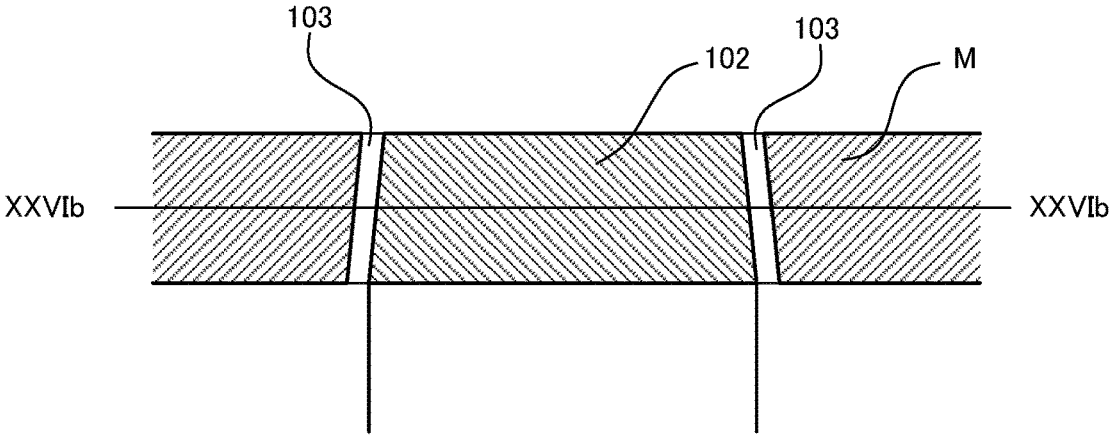
FIGS. 26A and 26B illustrate the step of FIG. 22(6).
Figure 26B:
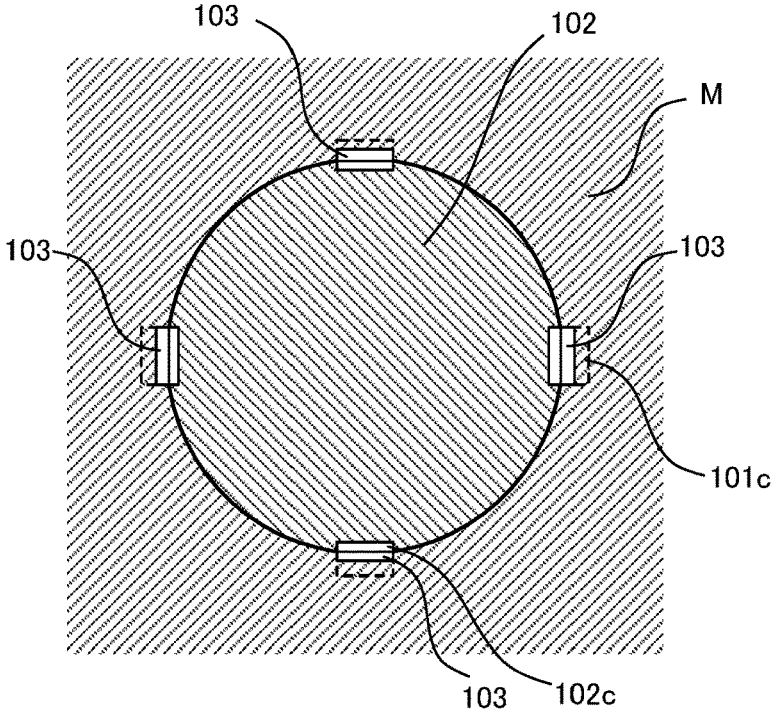
Figure 27A:
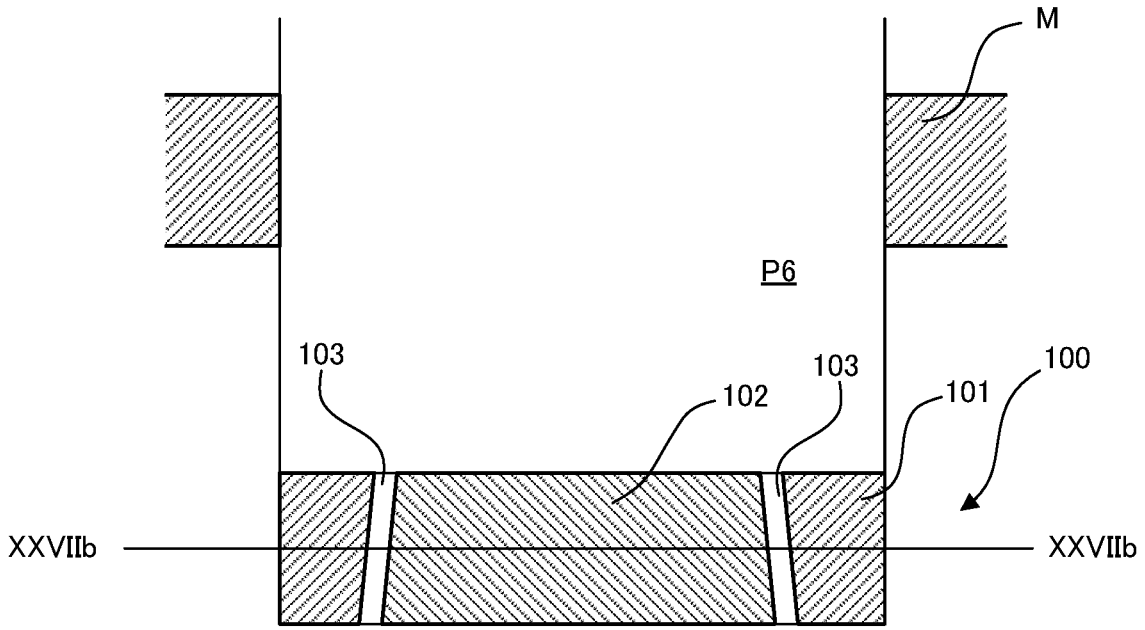
FIGS. 27A and 27B illustrate the step of FIG. 22(7).
Figure 27B:
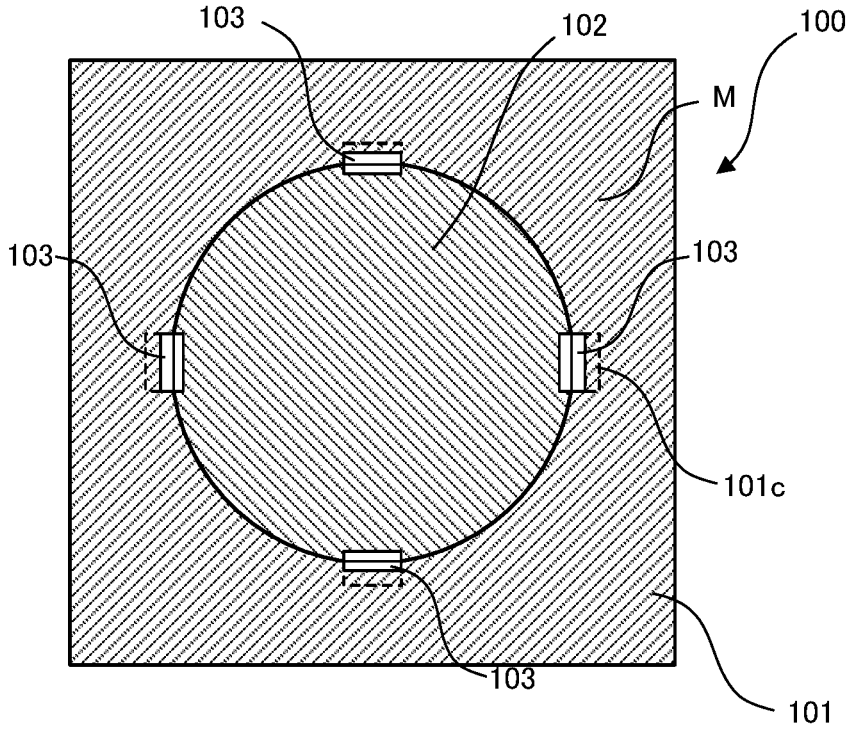

FIGS. 22(1) to 22(7) illustrate a machining method of the machined article according to the third embodiment. FIGS. 23A and 23B illustrate the step of FIG. 22(2). FIGS. 24A and 24B illustrate the step of FIG. 22(4). FIGS. 25A and 25B illustrate the step of FIG. 22(5). FIGS. 26A and 26B illustrate the step of FIG. 22(6). FIGS. 27A and 27B illustrate the step of FIG. 22(7).

As illustrated in FIGS. 22(1) to 22(7), the machined article 100 according to the third embodiment is formed by machining a band of material M.

Initially, in the step of (1) illustrated in FIG. 22, as illustrated in FIGS. 9A and 9B, the material M is circularly pressed by the first punch P1 to form a hole. Next, as illustrated in FIGS. 17A and 17B, part of the inner peripheral portion 101*a* formed by perforation is pressed by the protrusions P2*a* of the second punch P2 to form inner peripheral recesses 101*b* dented radially outward. A hole S1 is formed in the punched material M.

Next, in the step of (2) illustrated in FIG. 22, as illustrated in FIGS. 23A and 23B, the material M is pressed by third punches P3. Holes S2 are formed in the punched material M. The step of (2) may be performed simultaneously with or before the step of (1).

Next, in the step of (3) illustrated in FIG. 22, as illustrated in FIGS. 17A and 17B, outer side surfaces 101*c* of the inner peripheral recesses 101*b* at outer sides farthest from the inner peripheral portion 101*a* are obliquely formed in a tapered shape to get away from the inner peripheral portion 101*a* from the front to the back.

Next, in the step of (4) illustrated in FIG. 22, as illustrated in FIGS. 24A and 24B, respective inner side surfaces 102*c* close to a center Sc of the four holes S2 formed in the material M in the step of (2) are formed by fourth punches P4 in a tapered shape to get away from the center Sc of the four holes S2 from the front to the back. The step of (4) may be performed simultaneously with or before the step of (3).

Next, in the step of (5) illustrated in FIG. 22, as illustrated in FIGS. 25A and 25B, a second member 102 formed by pressing the material M by a fifth punch P5 is supported below. The second member 102 is punched out to include the inner side surfaces 102*c* formed in the step of (4).

Next, in the step of (6) illustrated in FIG. 22, the hole S1 formed in the step of (3) is moved to above the second member 102 supported below in the step of (5) as illustrated in FIGS. 25A and 25B. As illustrated in FIGS. 26A and 26B, the second member 102 is pressed and fitted into the hole S1 from below.

Finally, in the step of (7) illustrated in FIG. 22, as illustrated in FIGS. 27A and 27B, the periphery of the second member 102 fitted in the material M is pressed by a sixth punch P6 to complete the machined article 100.

In such a manner, the pressing method according to the third embodiment can easily and precisely machine the slits of minute dimensions. The slits can be easily and precisely machined even if the directions of the slits intersect with the direction of fitting of the second member into the first member.

Figure 28:
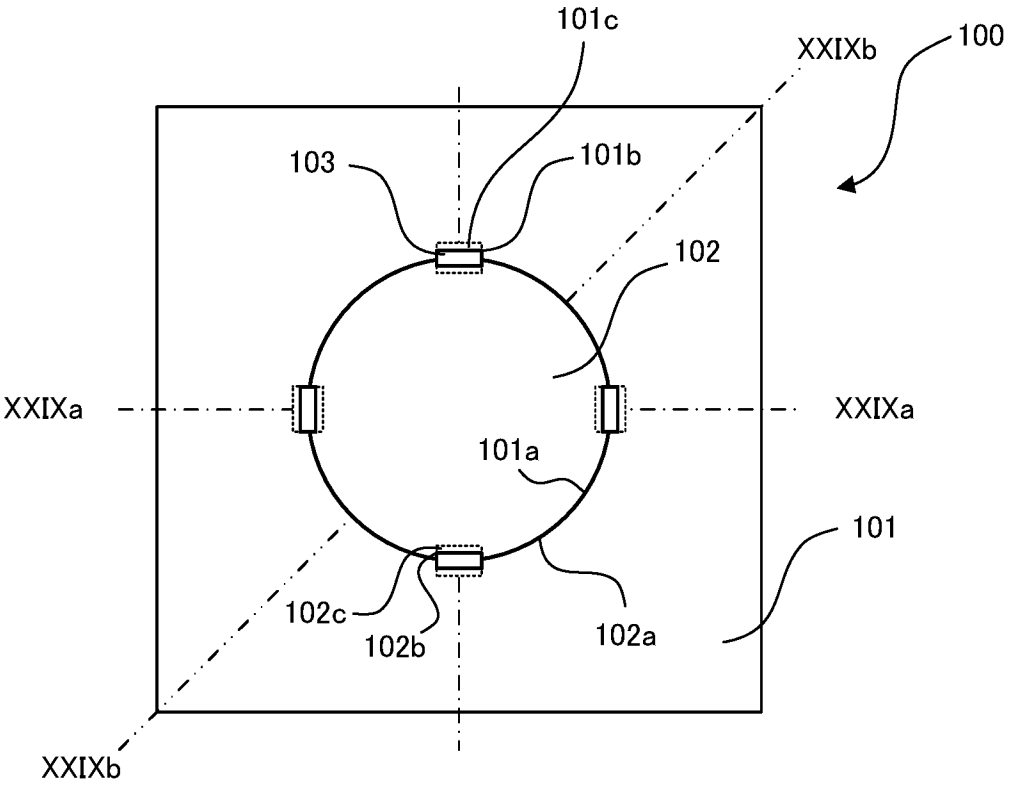
FIG. 28 illustrates a machined article according to a fourth embodiment.
Figure 29A:
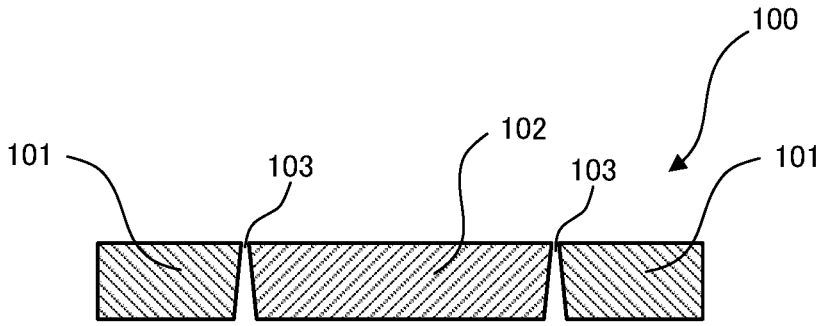
FIGS. 29A and 29B illustrate sectional views taken along lines XXIX-XXIX of FIG. 28.
Figure 29B:
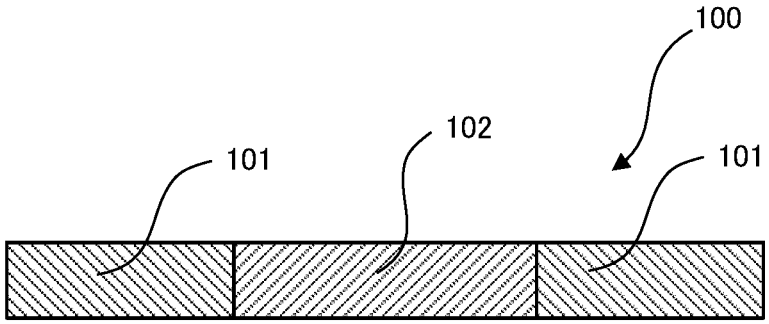

FIG. 28 illustrates a machined article according to a fourth embodiment. FIGS. 29A and 29B illustrate sectional views of FIG. 28. FIG. 29A illustrates a XXIXa-XXIXa section of FIG. 28. FIG. 29B illustrates a XXIXb-XXIXb of FIG. 28.

As illustrated in FIG. 28, a machined article 100 according to the fourth embodiment includes a first member 101 and a second member 102.

The first member 101 includes an inner peripheral portion 101*a* which is formed by perforation, and inner peripheral recesses 101*b* which are dented radially outward from the inner peripheral portion 101*a*. Outer side surfaces 101*c* of the inner peripheral recesses 101*b* at outer sides farthest from the inner peripheral portion 101*a* are obliquely formed in a tapered shape to get away from the inner peripheral portion 101*a* from the front to the back.

The second member 102 includes an outer peripheral portion 102*a* which is formed by pressing, and outer peripheral recesses 102*b* which are dented radially inward from the outer peripheral portion 102*a*. Inner side surfaces 102*c* of the outer peripheral recesses 102*b* at inner sides farthest from the outer peripheral portion 102*a* are obliquely formed in a tapered shape to get away from the outer peripheral portion 102*a* from the front to the back.

The outer peripheral portion 102*a* of the second member 102 has the same shape as that of the inner peripheral portion 101*a* of the first member 101. The machined article 100 formed by fitting the second member 102 into the first member 101 thus forms slits 103 penetrating from the front to the back at positions to which the inner peripheral recesses 101*b* and the outer peripheral recesses 102*b* correspond, between the first member 101 and the second member 102.

The machined article 100 according to the fourth embodiment can thus have the precisely-machined slits of minute dimensions. The directions of the slits can be set to increase the degree of freedom of design.

Figure 30:
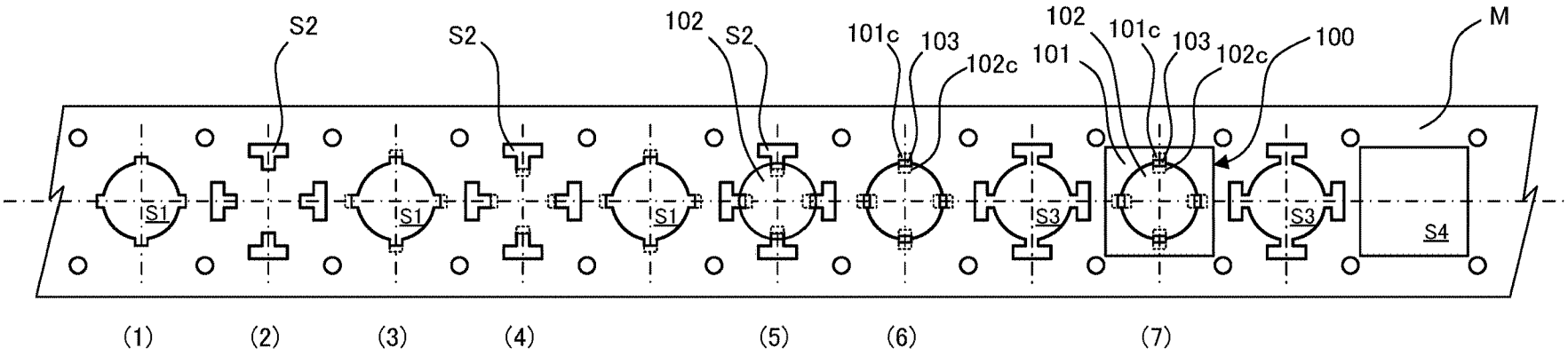
FIGS. 30(1) to 30(7) illustrate a machining method of the machined article according to the fourth embodiment.
Figure 31A:
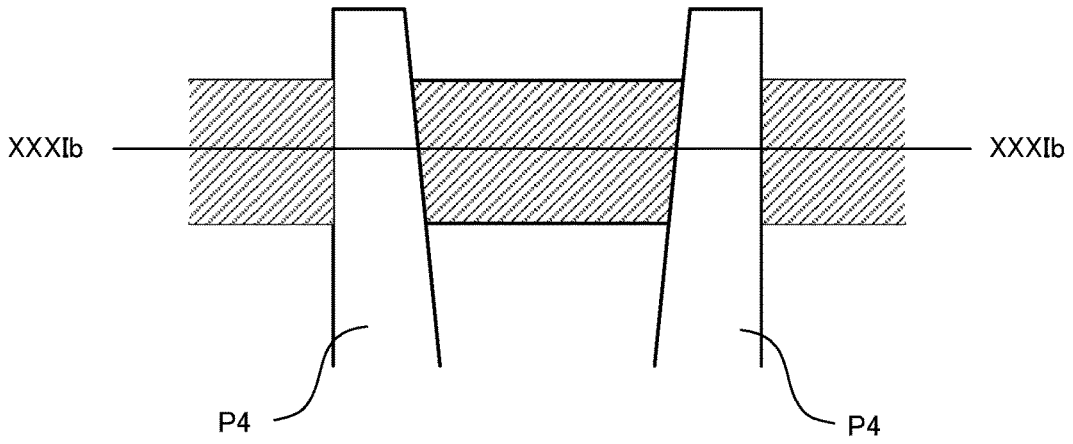
FIGS. 31A and 31B illustrate the step of FIG. 30(4).
Figure 31B:
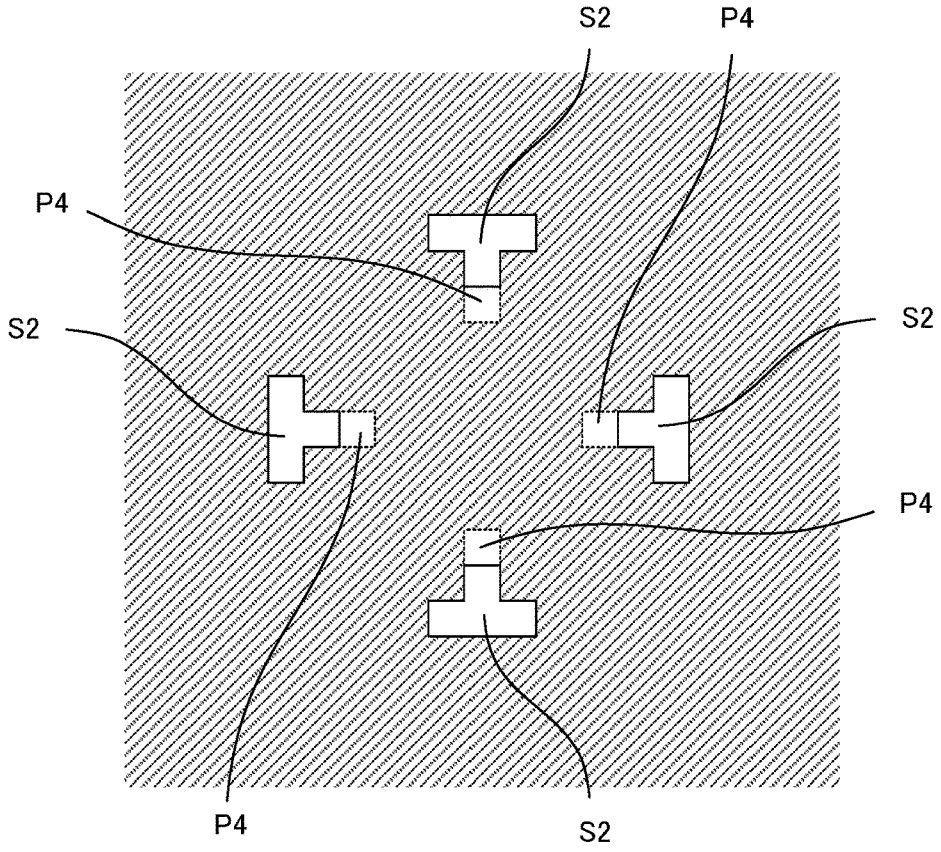
Figure 32A:
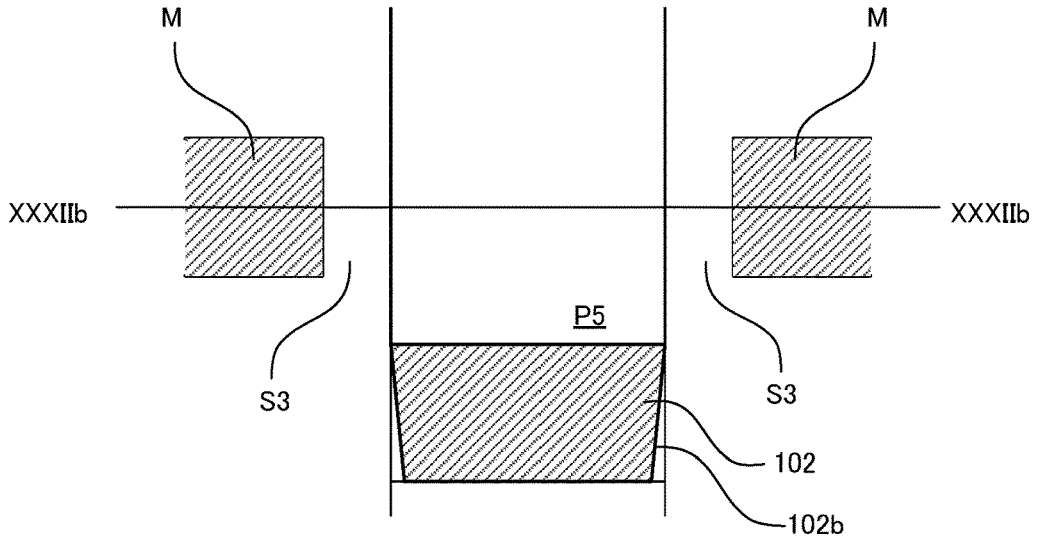
FIGS. 32A and 32B illustrate the step of FIG. 30(5).
Figure 32B:
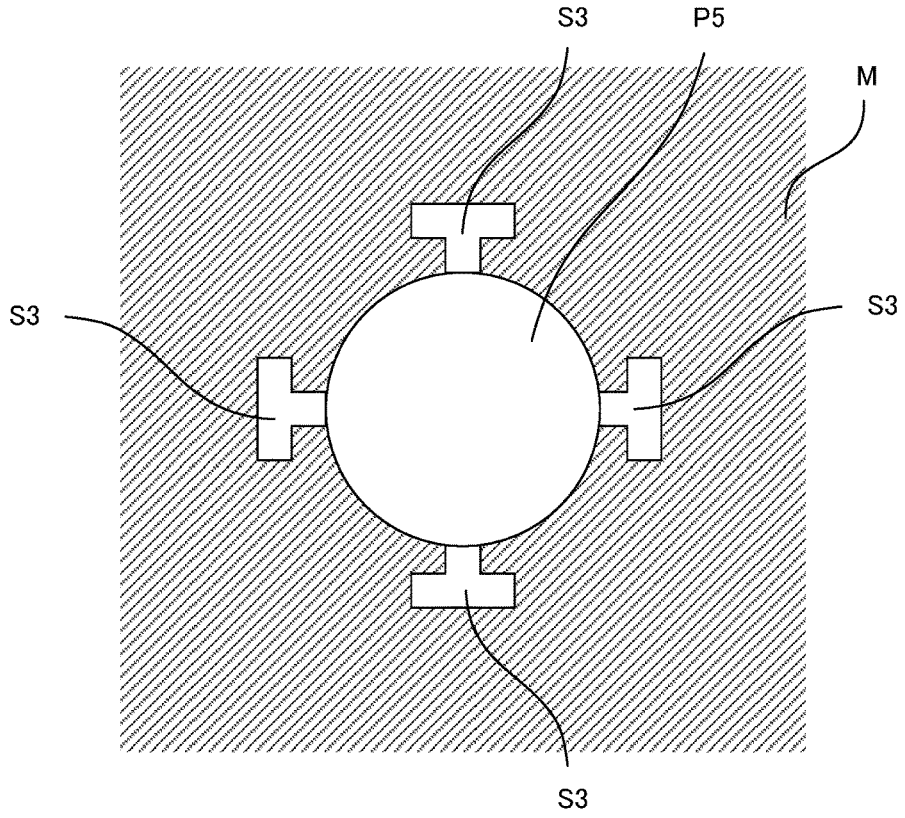
Figure 33A:
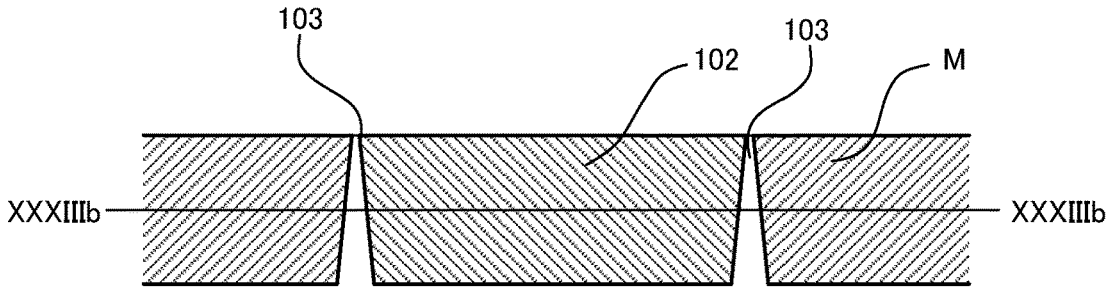
FIGS. 33A and 33B illustrate the step of FIG. 30(6).
Figure 33B:
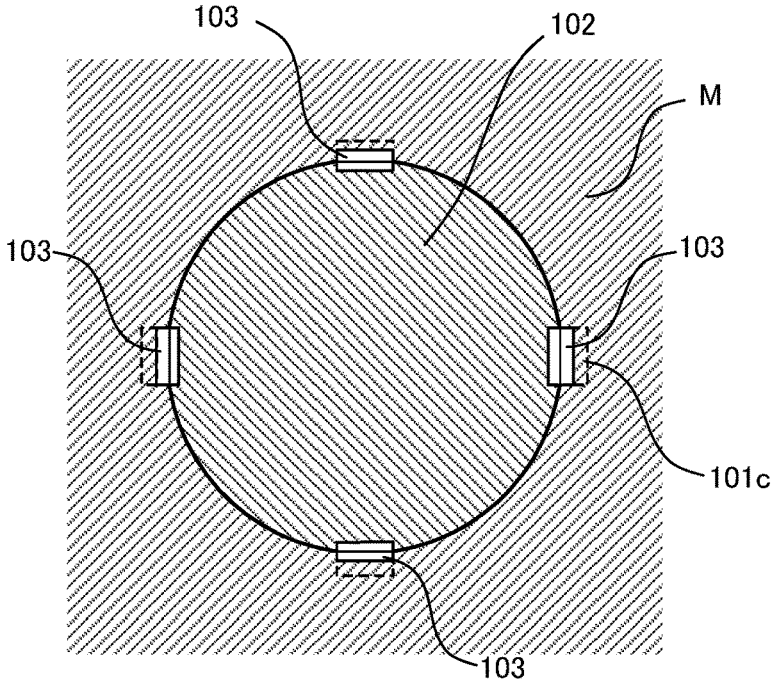
Figure 34A:
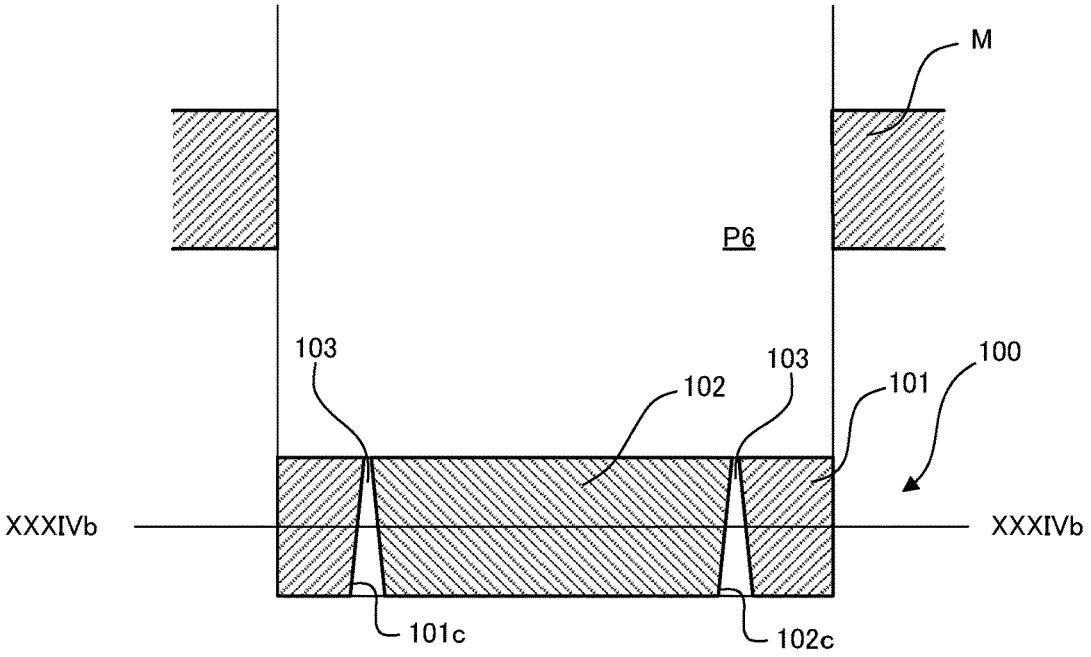
FIGS. 34A and 34B illustrate the step of FIG. 30(7).
Figure 34B:
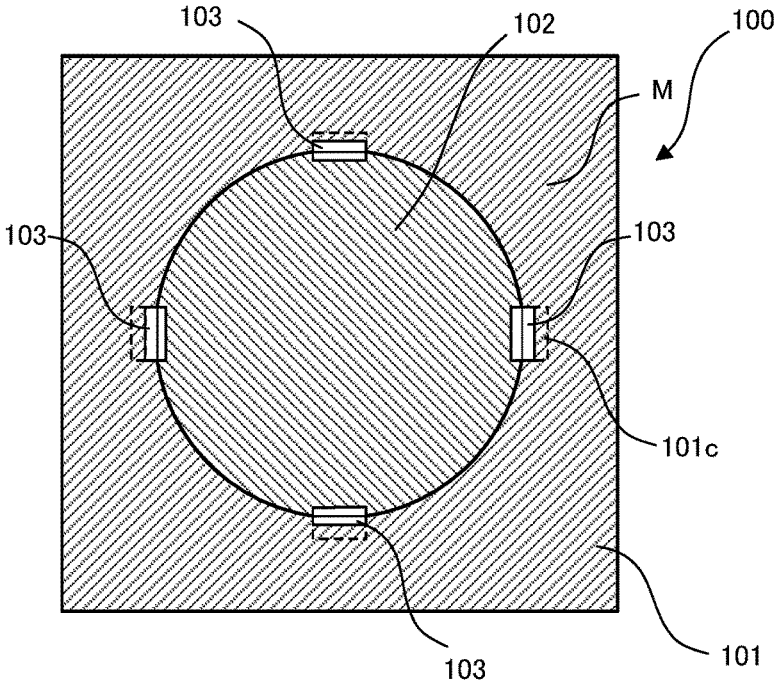

FIGS. 30(1) to 30(7) illustrate a machining method of the machined article according to the fourth embodiment. FIGS. 31A and 31B illustrate the step of FIG. 30(4). FIGS. 32A and 32B illustrate the step of FIG. 30(5). FIGS. 33A and 33B illustrate the step of FIG. 30(6). FIGS. 34A and 34B illustrate the step of FIG. 30(7).

As illustrated in FIGS. 30(1) to 30(7), the machined article 100 according to the fourth embodiment is formed by machining a band of material M.

Initially, in the step of (1) illustrated in FIG. 30, as illustrated in FIGS. 9A and 9B, the material M is circularly pressed by the first punch P1 to form a hole. Next, as illustrated in FIGS. 17A and 17B, part of the inner peripheral portion 101*a* formed by perforation is pressed by the protrusions P2*a* of the second punch P2 to form inner peripheral recesses 101*b* dented radially outward. A hole S1 is formed in the punched material M.

Next, in the step of (2) illustrated in FIG. 30, as illustrated in FIGS. 23A and 23B, the material M is pressed by the third punches P3. Holes S2 are formed in the punched material M. The step of (2) may be performed simultaneously with or before the step of (1).

Next, in the step of (3) illustrated in FIG. 30, as illustrated in FIGS. 17A and 17B, outer side surfaces 101*c* of the inner peripheral recesses 101*b* at outer sides farthest from the inner peripheral portion 101*a* are obliquely formed in a tapered shape to get away from the inner peripheral portion 101*a* from the front to the back.

Next, in step of (4) illustrated in FIG. 30, as illustrated in FIGS. 31A and 31B, respective inner side surfaces 102 close to a center Sc of the four holes S2 formed in the material M in the step of (2) are formed by the fourth punches P4 in a tapered shape to approach the center Sc of the fourth holes S2 from the front to the back. The step of (4) may be performed simultaneously with or before the step of (3).

Next, in the step of (5) illustrated in FIG. 30, as illustrated in FIGS. 32A and 32B, a second member 102 formed by punching the material M by a fifth punch P5 is supported below. The second member 102 is punched out to include the inner side surfaces 102*c* formed in the step of (4).

Next, in the step of (6) illustrated in FIG. 30, the hole S1 formed in the step of (3) is moved to above the second member 102 supported below in the step of (5) as illustrated in FIGS. 33A and 33B. As illustrated in FIGS. 33A and 33B, the second member 102 is pressed and fitted into the hole S1 from below.

Finally, in the step of (7) illustrated in FIG. 30, as illustrated in FIGS. 34A and 34B, the periphery of the second member 102 fitted in the material M is pressed by the sixth punch P6 to complete the machined article 100.

In such a manner, the pressing method according to the fourth embodiment can easily and precisely machine the slits of minute dimensions. The slits can be easily and precisely machined even if the directions of the slits intersect with the direction of fitting of the second member into the first member.

Figure 35:
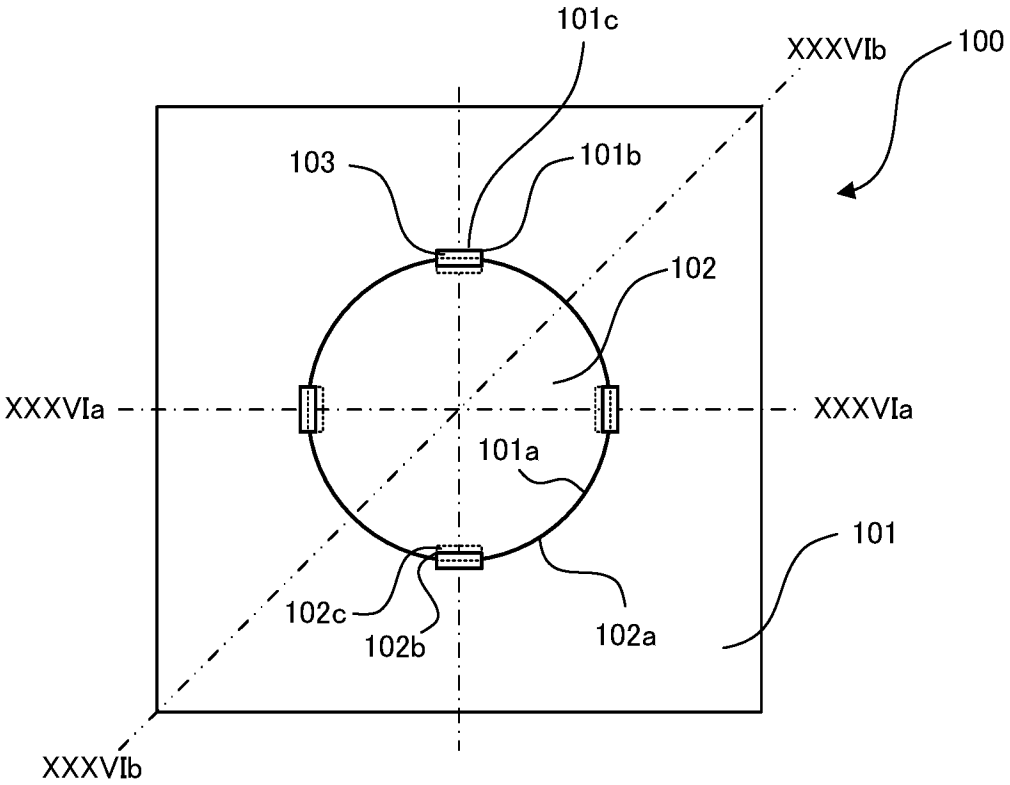
FIG. 35 illustrates a machined article according to a fifth embodiment.
Figure 36A:
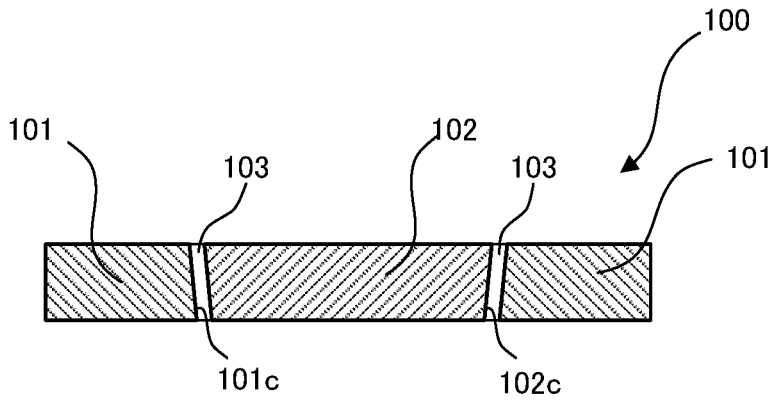
FIGS. 36A and 36B illustrate sectional views taken along lines XXXVI-XXXVI of FIG. 35.
Figure 36B:
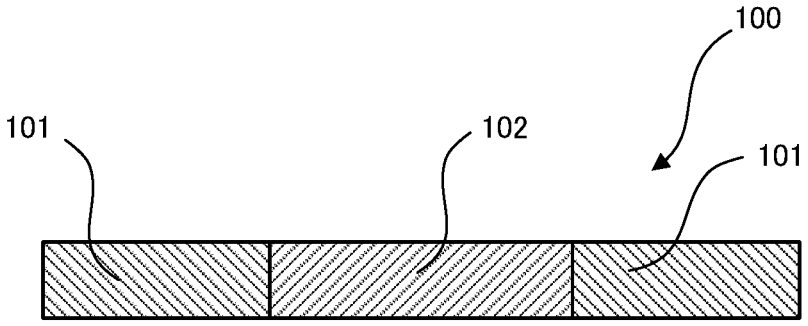

FIG. 35 illustrates a machined article according to a fifth embodiment. FIGS. 36A and 36B illustrate sectional views taken along lines XXXVI-XXXVI of FIG. 35. FIG. 36A illustrates a XXXVIa-XXXVIa section of FIG. 35. FIG. 36B illustrates a XXXVIb-XXXVIb section of FIG. 35.

As illustrated in FIG. 35, a machined article 100 according to the fifth embodiment includes a first member 101 and a second member 102.

The first member 101 includes an inner peripheral portion 101*a* which is formed by perforation, and inner peripheral recesses 101*b* which are dented radially outward from the inner peripheral portion 101*a*. Outer side surfaces 101*c* of the inner peripheral recesses 101*b* at outer sides farthest from the inner peripheral portion 101*a* are obliquely formed in a tapered shape to approach the inner peripheral portion 101*a* from the front to the back.

The second member 102 includes an outer peripheral portion 102*a* which is formed by pressing, and outer peripheral recesses 102*b* which are dented radially inward from the outer peripheral portion 102*a*. Inner side surfaces 102*c* of the outer peripheral recesses 102*b* at inner sides farthest from the outer peripheral portion 102*a* are obliquely formed in a tapered shape to get away from the outer peripheral portion 102*a* from the front to the back.

The outer peripheral portion 102*a* of the second member 102 has the same shape as that of the inner peripheral portion 101*a* of the first member 101. The machined article 100 formed by fitting the second member 102 into the first member 101 thus forms slits 103 penetrating from the front to the back at positions to which the inner peripheral recesses 101*b* and the outer peripheral recesses 102*b* correspond, between the first member 101 and the second member 102.

The machined article according to the fifth embodiment can be formed by performing the machining method used for the machined article according to the third embodiment upside down.

The machined article 100 according to the fifth embodiment can thus have the precisely-machined slits of minute dimensions. The directions of the slits can be set to increase the degree of freedom of design.

Figure 37A:
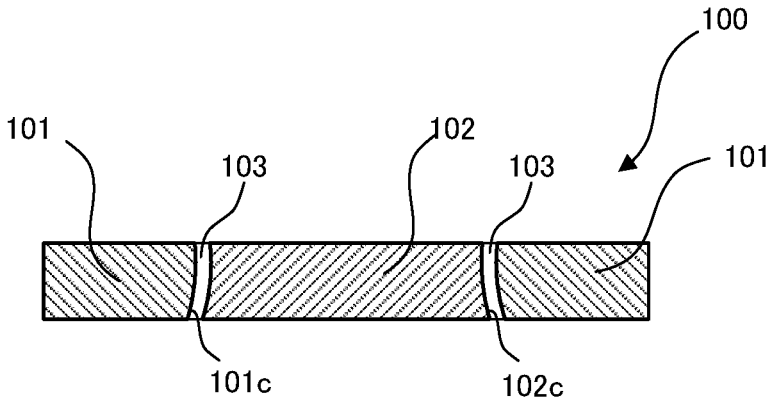
FIGS. 37A and 37B illustrate sectional views of a machined article according to a sixth embodiment.
Figure 37B:
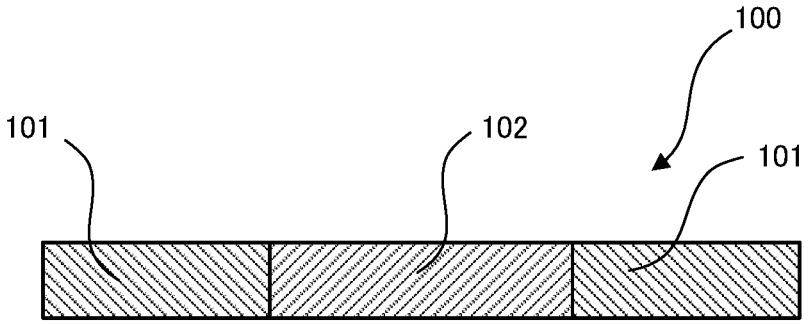

FIGS. 37A and 37B illustrate sectional views of a machined article according to a sixth embodiment.

As illustrated in FIGS. 37A and 37B, a machined article 100 according to the sixth embodiment includes slits 103 formed between a first member 101 and a second member 102. Outer side surfaces 101*c* of inner peripheral recesses 101*b* of the first member 101 at outer sides farthest from an inner peripheral portion 101*a* and inner side surfaces 102*c* of outer peripheral recesses 102*b* of the second member 102 at inner sides farthest from an outer peripheral portion 102*a* are formed by curved surfaces.

The outer side surfaces 101*c* of the first member 101 are formed to get away from the inner peripheral portion 101*a* from the front to the back. The inner side surfaces 102*c* of the second member 102 are formed to approach the outer peripheral portion 102*a* from the front to the back.

The machined article 100 according to the sixth embodiment can thus have the precisely-machined slits of minute dimensions. The directions and shapes of the slits can be set to further increase the degree of freedom of design.

Figure 38A:
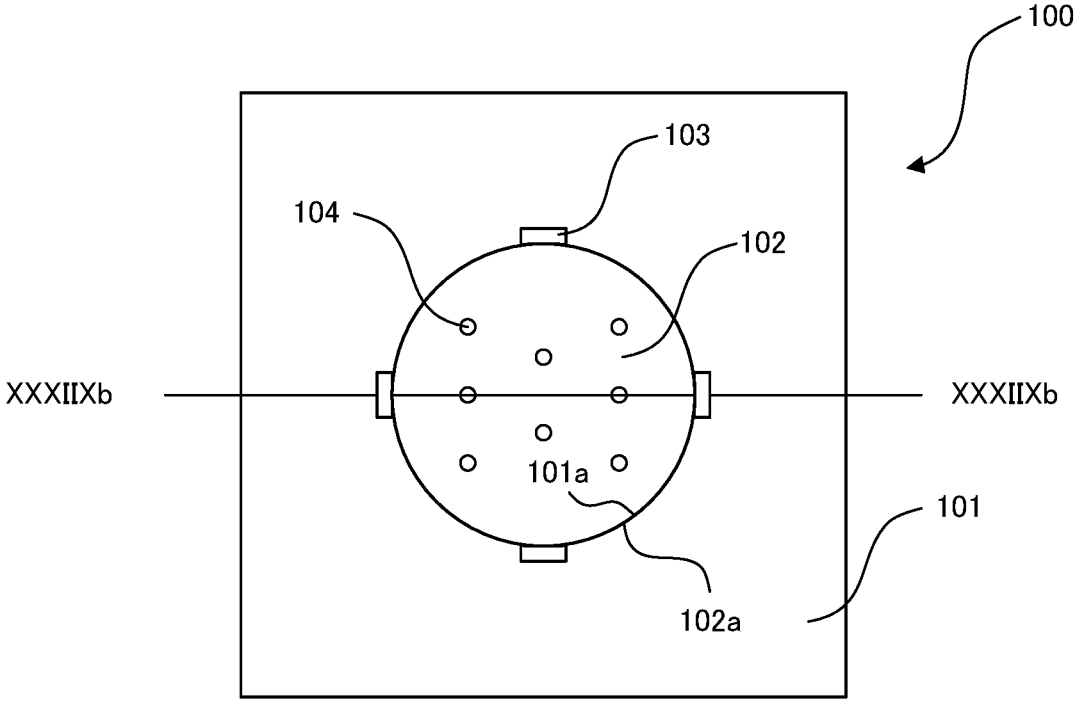
FIGS. 38A and 38B illustrate a machined article according to a seventh embodiment.
Figure 38B:
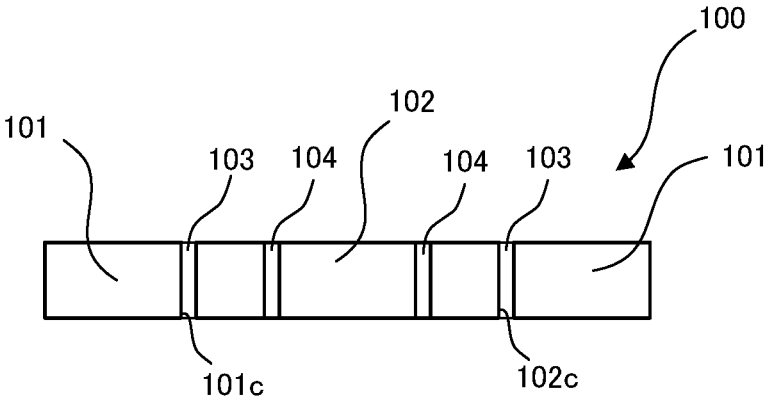

FIGS. 38A and 38B illustrate a machined article according to a seventh embodiment. FIG. 38A illustrates a plan view of the machined article. FIG. 38B illustrates a XXXIIXb-XXXIIXb cross section of FIG. 38A.

As illustrated in FIGS. 38A and 38B, a machined article 100 according to the seventh embodiment includes a second member 102 in which at least one through hole 104 is formed. The formation of the through hole 104 can adjust the amount of fluid or powder to be jetted out.

The machined article 100 and the pressing method have been described above based on several embodiments. The present invention is not limited to such embodiments, and various combinations or modifications may be made.

REFERENCE SIGNS LIST

1: bed (frame)
2: support (frame)
3: crown (frame)
4: scale column
5: hydraulic cushion
7: control unit
11: inner slide (first slide)
12: inner motor (first-side driving source)
13: inner ball screw
14: inner position detection unit (first-side position detection unit)
21: outer slide (second slide)
22: outer motor (second-side driving source)
23: outer ball screw
24: outer position detection unit (second-side position detection unit)
30: die set
31: die set lower table
32: guide post
33: die set upper table
40: inner upper die unit (first upper die)
50: outer upper die unit (second upper die)
60: first lower die unit (lower die)
100: machined article
101: first member
101*a*: inner peripheral portion
101*b*: inner peripheral recess
101*c*: outer side surface
102: second member
102*a*: outer peripheral portion
102*b*: outer peripheral recess
102*c*: inner side surface
103: slit
104: through hole

The invention claimed is:

1. A machined article comprising:

a first member including an inner peripheral portion formed by a hole; and a second member including an outer peripheral portion fitted into the inner peripheral portion of the first member, wherein at least either an inner peripheral recess is formed in part of the inner peripheral portion of the first member or an outer peripheral recess is formed in part of the outer peripheral portion of the second member is formed, a slit penetrating from a top surface to a bottom surface of the machined article is formed at a position to which the inner peripheral recess or the outer peripheral recess corresponds, between the first member and the second member, the slit forming a gap between the first member and the second member;

the inner peripheral portion of the first member being continuous entirely from the top surface to the bottom surface of the machined article, and the second member being fitted into the inner peripheral portion of the first member such that the inner peripheral portion of the first member and the outer peripheral portion of the second member are in direct contact with each other where the slit is not formed, wherein the machine article is configured for jetting fluid or powder.

2. The machined article according to claim 1, wherein an outer side surface of the inner peripheral recess at an outer side farthest from the inner peripheral portion or an inner side surface of the outer peripheral recess at an inner side farthest from the outer peripheral portion is perpendicular to the top surface and the bottom surface of the machined article.

3. The machined article according to claim 2, wherein the outer side surface or the inner side surface is oblique with respect to a direction of fitting of the second member into the first member.

4. The machined article according to claim 2, wherein the outer side surface and the inner side surface are formed opposite to each other.

5. The machined article according to claim 4, wherein the outer side surface and the inner side surface are formed in parallel.

6. The machined article according to claim 1, wherein:

the first member and the second member are fitted by pressing; and the inner peripheral recess or the outer peripheral recess are formed by pressing.

7. A pressing method comprising the steps of:

providing a machined article comprising:

a first member including an inner peripheral portion formed by a hole; and a second member including an outer peripheral portion fitted into the inner peripheral portion of the first member, wherein at least either an inner peripheral recess is formed in part of the inner peripheral portion of the first member or an outer peripheral recess is formed in part of the outer peripheral portion of the second member is formed, a slit penetrating from a top surface to a bottom surface of the machined article is formed at a position to which the inner peripheral recess or the outer peripheral recess corresponds, between the first member and the second member, the slit forming a gap between the first member and the second member;

the inner peripheral portion of the first member being continuous entirely from the top surface to the bottom surface of the machined article, and the second member being fitted into the inner peripheral portion of the first member such that the inner peripheral portion of the first member and the outer peripheral portion of the second member are in direct contact with each other where the slit is not formed, wherein the machine article is configured for jetting fluid or powder, the method further comprising the step of:

pressing part of the first member out of material to form the inner peripheral portion; pressing part of the inner peripheral portion to form the inner peripheral recess; pressing the second member out of the material so that the outer peripheral portion is formed, and holding the second member;

and pressing the second member to fit the outer peripheral portion of the second member into the inner peripheral portion of the first member so that the inner peripheral recess forms the slit.

8. A pressing method comprising the steps of:

providing a machined article comprising:

a first member including an inner peripheral portion formed by a hole; and a second member including an outer peripheral portion fitted into the inner peripheral portion of the first member, wherein at least either an inner peripheral recess is formed in part of the inner peripheral portion of the first member or an outer peripheral recess is formed in part of the outer peripheral portion of the second member is formed, a slit penetrating from a top surface to a bottom surface of the machined article is formed at a position to which the inner peripheral recess or the outer peripheral recess corresponds, between the first member and the second member, the slit forming a gap between the first member and the second member;

the inner peripheral portion of the first member being continuous entirely from the top surface to the bottom surface of the machined article, and the second member being fitted into the inner peripheral portion of the first member such that the inner peripheral portion of the first member and the outer peripheral portion of the second member are in direct contact with each other where the slit is not formed, wherein the machine article is configured for jetting fluid or powder, the method further comprising the step of:

pressing part of the first member out of material to form the inner peripheral portion; pressing a corresponding position of the material to form the outer peripheral recess; pressing the second member so that the outer peripheral portion including the outer peripheral recess is formed of the material, and holding the second member; and pressing the second member to fit the outer peripheral portion of the second member into the inner peripheral portion of the first member so that the outer peripheral recess forms the slit.

9. A pressing method comprising the steps of:

providing a machined article comprising:

a first member including an inner peripheral portion formed by a hole; and a second member including an outer peripheral portion fitted into the inner peripheral portion of the first member, wherein at least either an inner peripheral recess is formed in part of the inner peripheral portion of the first member or an outer peripheral recess is formed in part of the outer peripheral portion of the second member is formed, a slit penetrating from a top surface to a bottom surface of the machined article is formed at a position to which the inner peripheral recess or the outer peripheral recess corresponds, between the first member and the second member, the slit forming a gap between the first member and the second member;

the inner peripheral portion of the first member being continuous entirely from the top surface to the bottom surface of the machined article, and the second member being fitted into the inner peripheral portion of the first member such that the inner peripheral portion of the first member and the outer peripheral portion of the second member are in direct contact with each other where the slit is not formed, wherein the machine article is configured for jetting fluid or powder, the method further comprising the step of:

pressing part of the first member out of material to form the inner peripheral portion; pressing part of the inner peripheral portion to form the inner peripheral recess; pressing a corresponding position of the material to form the outer peripheral recess; pressing the second member so that the outer peripheral portion including the outer peripheral recess is formed of the material, and holding the second member; and pressing the second member to fit the outer peripheral portion of the second member into the inner peripheral portion of the first member so that the inner peripheral recess and the outer peripheral recess form the slit.

10. The pressing method according to claim 7, wherein an outer side surface of the inner peripheral recess at an outer side farthest from the inner peripheral portion and an inner side surface of the outer peripheral recess at an inner side farthest from the outer peripheral portion intersect with a direction of fitting of the second member into the first member.

11. The pressing method according to claim 10, wherein the outer side surface or the inner side surface is oblique to the direction of fitting.

12. The pressing method according to claim 10, wherein the outer side surface and the inner side surface are formed opposite to each other.

13. The pressing method according to claim 12, wherein the outer side surface and the inner side surface are formed in parallel.

* * * * *